US009640867B2

(12) United States Patent
Behdad et al.

(10) Patent No.: US 9,640,867 B2
(45) Date of Patent: May 2, 2017

(54) TUNABLE SPATIAL PHASE SHIFTER

(71) Applicant: Wisconsin Alumni Research Foundation, Madison, WI (US)

(72) Inventors: Nader Behdad, Madison, WI (US); John Booske, McFarland, WI (US)

(73) Assignee: Wisconsin Alumni Research Foundation, Madison, WI (US)

( * ) Notice: Subject to any disclaimer, the term of this patent is extended or adjusted under 35 U.S.C. 154(b) by 127 days.

(21) Appl. No.: 14/672,632

(22) Filed: Mar. 30, 2015

(65) Prior Publication Data

US 2016/0294054 A1 Oct. 6, 2016

(51) Int. Cl.

| | |
|---|---|
| ***H01Q 3/36*** | (2006.01) |
| ***H01Q 3/32*** | (2006.01) |
| ***H01Q 21/06*** | (2006.01) |
| *H01P 1/18* | (2006.01) |

(52) U.S. Cl.

CPC ..... *H01Q 3/32* (2013.01); *H01Q 3/36* (2013.01); *H01Q 21/061* (2013.01); *H01P 1/18* (2013.01)

(58) Field of Classification Search

CPC ..... H01Q 15/04; H01Q 15/0026; H01Q 3/32
USPC ..... 343/746
See application file for complete search history.

(56) References Cited

U.S. PATENT DOCUMENTS

| | | | | |
|---|---|---|---|---|
| 4,381,509 A | | 4/1983 | Rotman et al. | |
| 4,588,994 A | | 5/1986 | Tang et al. | |
| 4,684,952 A | * | 8/1987 | Munson | H01Q 21/065 342/368 |
| 5,389,939 A | | 2/1995 | Tang et al. | |
| 5,821,908 A | | 10/1998 | Sreenivas | |
| 6,388,616 B1 | | 5/2002 | Zhou | |
| 6,911,941 B2 | | 6/2005 | Tebbe et al. | |
| 6,987,591 B2 | * | 1/2006 | Shaker | G01N 22/02 359/1 |

(Continued)

FOREIGN PATENT DOCUMENTS

| | | |
|---|---|---|
| EP | 2182582 A1 | 5/2010 |
| EP | 2221919 A1 | 8/2010 |

(Continued)

OTHER PUBLICATIONS

Abadi et al., Ultra-Wideband, True-Time-Delay Reflectarray Antennas Using Ground-Plane-Backed, Miniaturized-Element Frequency Selective Surfaces, IEEE Transactions on Antennas and Propagation, vol. 63, No. 2, Dec. 18, 2014, pp. 534-542.

(Continued)

*Primary Examiner* — Huedung Mancuso
(74) *Attorney, Agent, or Firm* — Bell & Manning, LLC

(57) ABSTRACT

A tunable phase shifter is provided that includes a spatial phase shift element and a conducting sheet. The spatial phase shift element includes a dielectric substrate and a conductive antenna element mounted on the dielectric substrate. The conducting sheet is mounted a distance from the spatial phase shift element and configured to reflect an electromagnetic wave through the spatial phase shift element. The conductive antenna element is configured to radiate a second electromagnetic wave in response to receipt of the reflected electromagnetic wave. The distance between the conducting sheet and the spatial phase shift element can be changed to adjust a phase shift of the reflected electromagnetic wave.

20 Claims, 21 Drawing Sheets

(56) References Cited

U.S. PATENT DOCUMENTS

| | | | | |
|---|---|---|---|---|
| 7,113,131 | B2 * | 9/2006 | Burke | G08B 13/2414 340/572.8 |
| 7,298,555 | B2 | 11/2007 | Capps | |
| 7,898,480 | B2 | 3/2011 | Ebling et al. | |
| 8,134,511 | B2 | 3/2012 | Koh et al. | |
| 8,743,000 | B2 * | 6/2014 | Gagnon | H01Q 15/0006 343/753 |
| 8,941,540 | B2 * | 1/2015 | Harper | H01Q 9/28 343/700 MS |
| 9,368,879 | B1 * | 6/2016 | Manry, Jr. | H01Q 21/26 |
| 9,425,512 | B2 * | 8/2016 | Maruyama | H01Q 21/0018 |
| 2004/0017331 | A1 | 1/2004 | Crawford et al. | |
| 2004/0104860 | A1 | 6/2004 | Durham et al. | |
| 2006/0028386 | A1 | 2/2006 | Ebling et al. | |
| 2006/0044199 | A1 | 3/2006 | Furuhi et al. | |
| 2008/0055175 | A1 | 3/2008 | Rebeiz et al. | |
| 2008/0088525 | A1 * | 4/2008 | Jonathan | H01Q 3/46 343/909 |
| 2008/0284668 | A1 | 11/2008 | Justice et al. | |
| 2009/0273527 | A1 | 11/2009 | Behdad | |
| 2010/0033389 | A1 | 2/2010 | Yonak et al. | |
| 2010/0103049 | A1 | 4/2010 | Tabakovic | |
| 2010/0194663 | A1 | 8/2010 | Rothwell et al. | |
| 2010/0207833 | A1 | 8/2010 | Toso et al. | |
| 2010/0220035 | A1 | 9/2010 | Lee et al. | |
| 2010/0225562 | A1 | 9/2010 | Smith | |
| 2010/0283695 | A1 | 11/2010 | Geterud | |
| 2011/0025432 | A1 | 2/2011 | Gagnon et al. | |
| 2011/0175780 | A1 | 7/2011 | Gatti et al. | |
| 2011/0210903 | A1 | 9/2011 | Sarabandi et al. | |
| 2012/0033618 | A1 | 2/2012 | Wallace et al. | |
| 2012/0056787 | A1 | 3/2012 | Tatarnikov et al. | |
| 2012/0076498 | A1 | 3/2012 | Sayeed et al. | |
| 2012/0088459 | A1 | 4/2012 | Neto et al. | |
| 2013/0322495 | A1 | 12/2013 | Behdad et al. | |

FOREIGN PATENT DOCUMENTS

| | | | |
|---|---|---|---|
| WO | WO 2007/127955 | A2 | 11/2007 |
| WO | WO 2008/061107 | A2 | 5/2008 |

OTHER PUBLICATIONS

Rao et al., Measurement Results of an Affordable Hybrid Phased Array Using a Radant Lens, Naval Research Laboratory Memo Report No. 5320-00-8439, May 15, 2000, Washington, D.C.

Romisch et al., Multi-Beam Discrete Lens Arrays with Amplitude-Controlled Steering, 2003 IEEE MTT-S International Microwave Symposium Digest, Philadelphia, PA, Jun. 2003, pp. 1669-1672.

Romisch et al., Multibeam Planar Discrete Millimeter-Wave Lens for Fixed-Formation Satellites, 2002 URSI General Assembly Digest, Maastricht, the Netherlands, Aug. 2002.

Abbaspour-Tamijani et al., A planar filter-lens array for millimeter-wave applications, Proceedings of the IEEE International Antennas and Propagation Society International Symposium, vol. 1, Monterey, CA, Jun. 20-25, 2004, pp. 675-678.

International Search Report and Written Opinion received in PCT/US2011/045911, Jan. 19, 2012.

Lee et al., Multi-Beam Phased Array Antennas, Jan. 1, 2002, http://www.archive.org/details/nasa_techdoc_20030020930.

Hong et al., Spatial Processing With Lens Antenna Arrays for Direction-of-Arrival Estimation, Proceedings from "International Union of Radio Science" 27th General Assembly, Aug. 17-24, 2002, Maastricht, the Netherlands, http://www.ursi.org/Proceedings/ProcGA02/ursiga02.pdf.

Schoenberg et al., Two-level power combining using a lens amplifier, IEEE Trans. Microwave Theory Techn., Dec. 1994, vol. 42, No. 12, pp. 2480-2485.

Shiroma et al., A quasi-optical receiver with angle diversity, Proceedings of the IEEE International Microwave Symposium, San Francisco, 1996, pp. 1131-1134.

McGrath, Planar three-dimensional constrained lenses, IEEE Trans. Antennas Propagat., Jan. 1986, vol. 34, No. 1, pp. 46-50.

Hollung et al., A bi-directional quasi-optical lens amplifier, IEEE Trans. Microwave Theory Techn., Dec. 1997, vol. 45, No. 12, pp. 2352-2357.

Popovic et al., Quasi-optical transmit/receive front ends, IEEE Trans. Microwave Theory Techn., Nov. 1998, vol. 48, No. 11, pp. 1964-1975.

Pozar, Flat lens antenna concept using aperture coupled microstrip patches, Electronics Letters, Nov. 7, 1996, vol. 32, No. 23, pp. 2109-2111.

Sauleau et al., Quasi axis-symmetric integrated lens antennas: design rules and experimental/manufacturing trade-offs at millimeter-wave frequencies, Microwave and Optical Technology Letters, Jan. 2006, vol. 48, No. 1, pp. 20-29.

Al-Joumayly et al., Slide presentation of "Design of conformal, high-resolution microwave lenses using sub wavelength periodic structures", 2010 IEEE Antennas and Propagation Society/URSI Symposium, Toronto, ON , Jul. 11-17, 2010.

Al-Joumayly et al., Abstract of "Design of conformal, high-resolution microwave lenses using sub wavelength periodic structures", 2010 IEEE Antennas and Propagation Society/URSI Symposium, Toronto, ON, Jul. 11, 2010.

Al-Joumayly et al., Power Point Presentation "Wideband True-Time-Delay Microwave Lenses Using Low-Profile, Sub-Wavelength Periodic Structures", Jul. 2011.

Notice of Allowance issued in U.S. Appl. No. 12/891,887, Apr. 25, 2014.

Abadi et al., Harmonic-Suppressed Miniaturized-Element Frequency Selective Surfaces With Higher Order Bandpass Responses, IEEE Transactions on Antennas and Propagation, vol. 62, No. 5, Jan. 30, 2014, pp. 2562-25781.

Li et al., Wideband True-Time-Delay Microwave Lenses Based on Metallo-Dielectric and All-Dielectric Lowpass Frequency Selective Surfaces, IEEE Transactions on Antennas and Propagation, vol. 61, No. 8, May 17, 2013, pp. 4109-4119.

Li et al., Frequency Selective Surfaces for Pulsed High-Power Microwave Applications, IEEE Transactions on Antennas and Propagation, vol. 61, No. 2, Oct. 18, 2012, pp. 677-687.

Li et al., All-Dielectric, True-Time-Delay, Planar Microwave Lenses, Antennas and Propagation Society International Symposium, Jul. 7, 2013, Orlando, FL, IEEE, pp. 1172-1173.

Li et al., Broadband True-Time-Delay Microwave Lenses Based on Miniaturized Element Frequency Selective Surfaces, IEEE Transactions on Antennas and Propagation, vol. 61, No. 3, Nov. 16, 2012, pp. 1166-1179.

Non-Final Office Action issued for U.S. Appl. No. 13/483,381, mailed on Jul. 2, 2015, 21 pp.

Final Office Action issued for U.S. Appl. No. 13/483,381, mailed on Jan. 14, 2016, 23 pp.

* cited by examiner

TUNABLE SPATIAL PHASE SHIFTER

REFERENCE TO GOVERNMENT RIGHTS

This invention was made with government support under 1101146 awarded by the National Science Foundation. The government has certain rights in the invention.

BACKGROUND

A phased array antenna is an array of antennas in which a relative phase of signals feeding the antennas is varied such that an effective radiation pattern of the array is reinforced in a desired direction and suppressed in undesired directions to provide electronic steering of a beam. To convert a reflector array into a beam steerable antenna, a phase shift distribution provided by spatial phase shifting pixels must be dynamically changed depending on the direction of the desired output beam in the far field. Conventionally, this is achieved by changing a capacitance provided by capacitive patches by loading them with varactors or switches.

SUMMARY

In an illustrative embodiment, a tunable phase shifter is provided. The tunable phase shifter includes, but is not limited to, a spatial phase shift element and a conducting sheet. The spatial phase shift element includes, but is not limited to, a dielectric substrate and a conductive antenna element mounted on the dielectric substrate. The conducting sheet is mounted a distance from the spatial phase shift element and is configured to reflect an electromagnetic wave through the spatial phase shift element. The conductive antenna element is configured to radiate a second electromagnetic wave in response to receipt of the reflected electromagnetic wave. The distance between the conducting sheet and the spatial phase shift element can be changed to adjust a phase shift of the reflected electromagnetic wave.

In another illustrative embodiment, a phased array antenna is provided. The phased array antenna includes, but is not limited to, a feed antenna and a plurality of spatial phase shift elements distributed linearly in a direction. The feed antenna is configured to radiate an electromagnetic wave. Each spatial phase shift element of the plurality of spatial phase shift elements includes, but is not limited to, a dielectric substrate and a conductive antenna element mounted on the dielectric substrate. The conducting sheet is mounted a distance from the plurality of spatial phase shift elements and is configured to reflect an electromagnetic wave through the plurality of spatial phase shift elements. The conductive antenna element of each of the plurality of spatial phase shift elements is configured to radiate a second electromagnetic wave in response to receipt of the reflected electromagnetic wave. The distance between the conducting sheet and the plurality of spatial phase shift elements can be changed to adjust a phase shift of the reflected electromagnetic wave.

In yet another illustrative embodiment, a phased array antenna is provided. The phased array antenna includes, but is not limited to, a feed antenna and a radiating antenna. The feed antenna is configured to radiate an electromagnetic wave. The radiating antenna includes, but is not limited to, a plurality of spatial phase shift elements distributed linearly in a direction and an actuator. Each spatial phase shift element of the plurality of spatial phase shift elements includes, but is not limited to, a dielectric substrate and a conductive antenna element mounted on the dielectric substrate. The conducting sheet is mounted a distance from the plurality of spatial phase shift elements and is configured to reflect the radiated electromagnetic wave through the plurality of spatial phase shift elements. The conductive antenna element of each of the plurality of spatial phase shift elements is configured to radiate a second electromagnetic wave in response to receipt of the reflected electromagnetic wave. The actuator is mounted to the radiating antenna and is configured to change the distance between the conducting sheet and the plurality of spatial phase shift elements.

Other principal features of the disclosed subject matter will become apparent to those skilled in the art upon review of the following drawings, the detailed description, and the appended claims.

BRIEF DESCRIPTION OF THE DRAWINGS

Illustrative embodiments of the disclosed subject matter will hereafter be described referring to the accompanying drawings, wherein like numerals denote like elements.

DETAILED DESCRIPTION

Figures 1A, 1B, 1C:
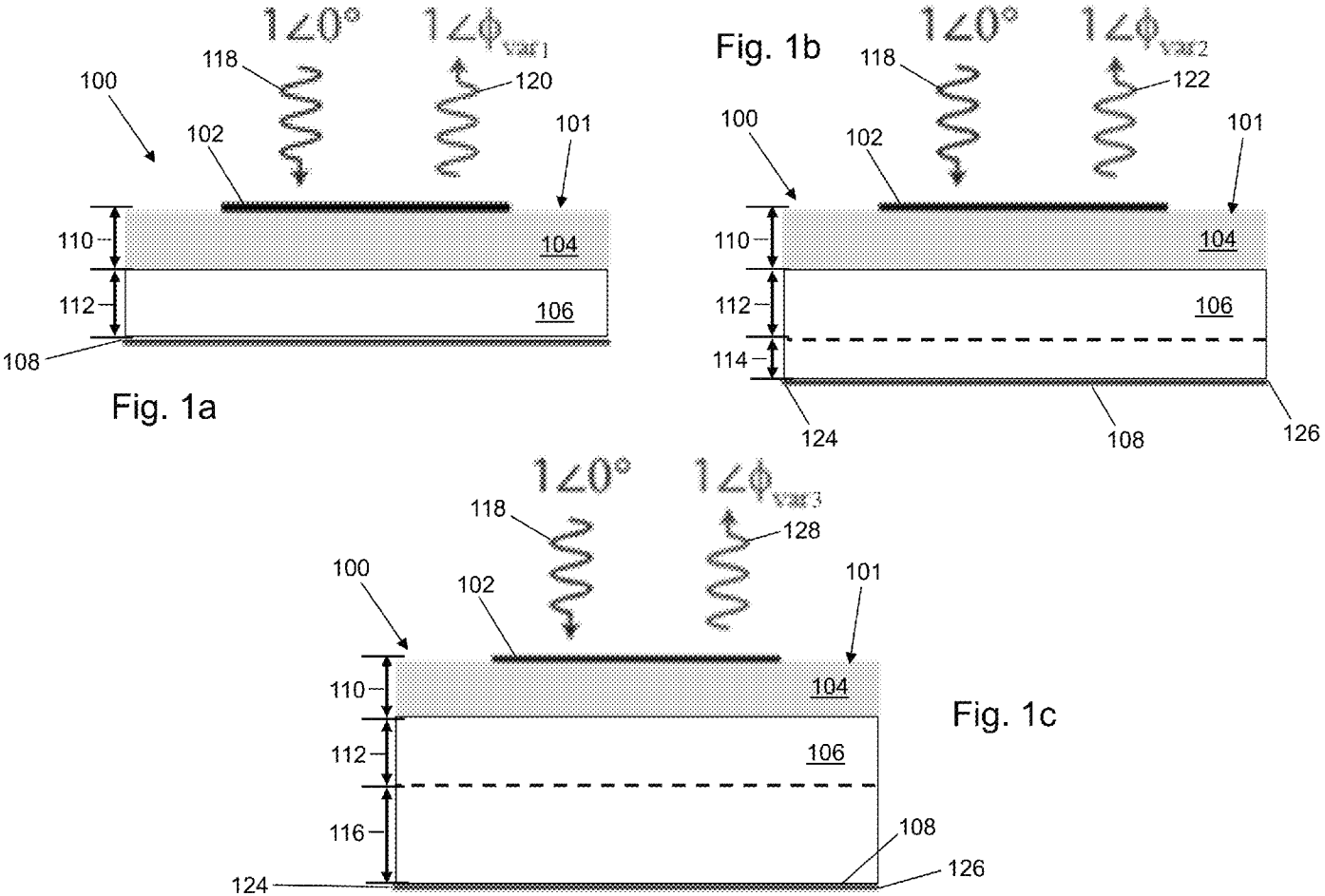
FIGS. 1*a*, 1*b*, and 1*c* depict side views of a tunable phase shifter in accordance with an illustrative embodiment with a conducting sheet moved to different positions.

With reference to FIG. 1*a*, a side view of a tunable phase shifter 100 is shown in accordance with an illustrative embodiment. Tunable phase shifter 100 may include a spatial phase shift element 101 and a conducting sheet 108. Spatial phase shift element 101 may include a dielectric substrate 104 and a conductive antenna element 102 mounted on dielectric substrate 104. Dielectric substrate 104 is formed of a dielectric material having a thickness 110, t. Dielectric substrate 104 is thin such that $t \ll \lambda_c$, where $\lambda_c$ is a wavelength of operation. A spacer 106 may separate spatial phase shift element 101 from conducting sheet 108 to mount conducting sheet 108 a distance 112 from spatial phase shift element 101. Spacer 106 may be filled with a dielectric material such as air. Spacer 106 may be formed by one or more walls (not shown) that support or make-up spatial phase shift element 101 and/or conducting sheet 108. Distance 112 may be zero such that conducting sheet 108 approximately abuts dielectric substrate 104 in an illustrative embodiment.

As used herein, the term "mount" includes join, unite, connect, couple, associate, insert, hang, hold, affix, attach, fasten, bind, paste, secure, bolt, screw, rivet, solder, weld, glue, form over, form in, layer, mold, rest on, rest against, etch, abut, and other like terms. The phrases "mounted on", "mounted to", and equivalent phrases indicate any interior or exterior portion of the element referenced. These phrases also encompass direct mounting (in which the referenced elements are in direct contact) and indirect mounting (in which the referenced elements are not in direct contact, but are connected through an intermediate element). Elements referenced as mounted to each other herein may further be integrally formed together, for example, using a molding or thermoforming process as understood by a person of skill in the art. As a result, elements described herein as being mounted to each other need not be discrete structural elements. The elements may be mounted permanently, removably, or releasably unless specified otherwise.

An electromagnetic wave 118 received by spatial phase shift element 101 of tunable phase shifter 100 is reflected by conducting sheet 108 back through spatial phase shift element 101 resulting in a change in phase $\Phi_{var1}$ of a reflected electromagnetic wave 120 relative to electromagnetic wave 118. For example, characteristics (such as the dimensions, the materials, the arrangement) of spatial phase shift element 101, spacer 106, and conducting sheet 108 are selected to generate a phase change $\Phi_{var1}$ when conducting sheet 108 is separated from spatial phase shift element 101 by distance 112 as discussed further below.

Referring to FIG. 1*b*, tunable phase shifter 100 is shown after movement of conducting sheet 108 to increase distance 112 by a second distance 114. Conducting sheet 108 may be moved by a first actuator (not shown) mounted to move a first edge 124 the second distance 114 relative to spatial phase shift element 101 and by a second actuator (not shown) mounted to move a second edge 126 the second distance 114 relative to spatial phase shift element 101. Electromagnetic wave 118 received by tunable phase shifter 100 is reflected by conducting sheet 108 back through spatial phase shift element 101 resulting in a change in phase $\Phi_{var2}$ of a second reflected electromagnetic wave 122 relative to electromagnetic wave 118. Second distance 114 is selected to generate a differential phase change $\Phi_{var2}-\Phi_{var1}$ relative to the configuration shown in FIG. 1*a*.

An actuator may include an electric motor such as a brushed or brushless DC or AC motor, a servo motor, a stepper motor, a piezoelectric actuator, a pneumatic actuator, a gas motor, an induction motor, a gear motor, a harmonic, cable, worm, or other gear drive, a magnetic actuator, etc. The actuator may be used with or without sensors. The actuator may generate linear or rotating motion. As understood by a person of skill in the art, other mechanical devices such as gears may be incorporated to convert the motion generated by the actuator to move one or more portion of conducting sheet 108 as described.

Referring to FIG. 1*c*, tunable phase shifter 100 is shown after movement of conducting sheet 108 to increase distance 112 by a third distance 116. Conducting sheet 108 may be moved by the first actuator mounted to move first edge 124 the third distance 116 relative to spatial phase shift element 101 and by the second actuator mounted to move second edge 126 the third distance 116 relative to spatial phase shift element 101. Electromagnetic wave 118 received by tunable phase shifter 100 is reflected by conducting sheet 108 back through spatial phase shift element 101 resulting in a change in phase $\Phi_{var3}$ of a third reflected electromagnetic wave 128 relative to electromagnetic wave 118. Third distance 116 is selected to generate a differential phase change $\Phi_{var3}-\Phi_{var1}$ relative to the configuration shown in FIG. 1*a*.

By moving conducting sheet 108 relative to spatial phase shift element 101, the phase shift of the reflected electromagnetic wave can be changed. Of course, either or both of conducting sheet 108 and spatial phase shift element 101 can be moved relative to the other to generate a desired phase shift in the reflected electromagnetic wave that is radiated by tunable phase shifter 100. The differential phase shift can be generated by moving conducting sheet 108 and spatial phase shift element 101 closer to each other or farther apart.

Conducting sheet 108 is a conducting surface with high conductivity that reflects received electromagnetic waves. Conducting sheet 108 is connected to a fixed potential that may be, but is not necessarily, a ground potential. Conducting sheet 108 may be generally flat or formed of ridges or bumps. Conducting sheet 108 may not be a continuous surface. Instead, conducting sheet 108 may be formed of separately movable sections. For illustration, conducting sheet 108 may be formed of a flexible membrane coated with a conductor.

Conductive antenna element 102 is formed of a conductive material having a high conductivity and may form a variety of shapes having a variety of dimensions (length, width, depth) based on the desired radiating characteristics of the radiated electromagnetic wave, such as first reflected electromagnetic wave 120, second reflected electromagnetic wave 122, and third reflected electromagnetic wave 128, as discussed further below. For example, conductive antenna element 102 may be formed of a patch antenna element, a resonant dipole antenna element, a tri-pole antenna element, a Jerusalem cross antenna element, a split ring resonator antenna element, a multi-element dipole antenna element, etc.

Figure 2B:
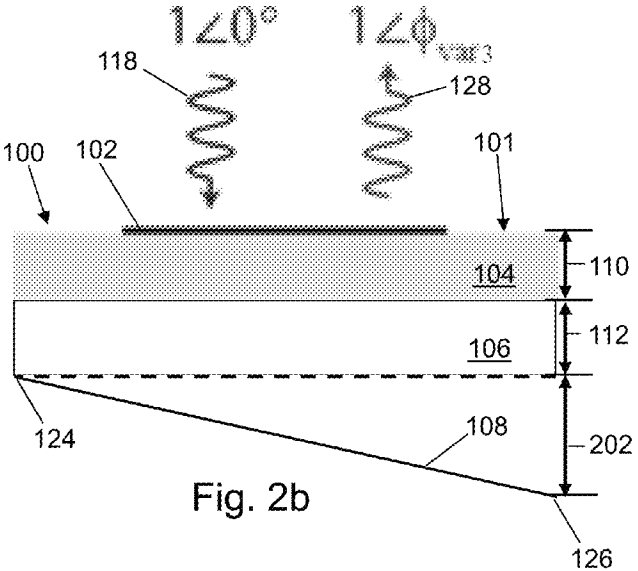
FIGS. 2*a*, 2*b*, and 2*c* depict side views of a second tunable phase shifter in accordance with an illustrative embodiment with a conducting sheet moved to different positions.
Figure 2A:
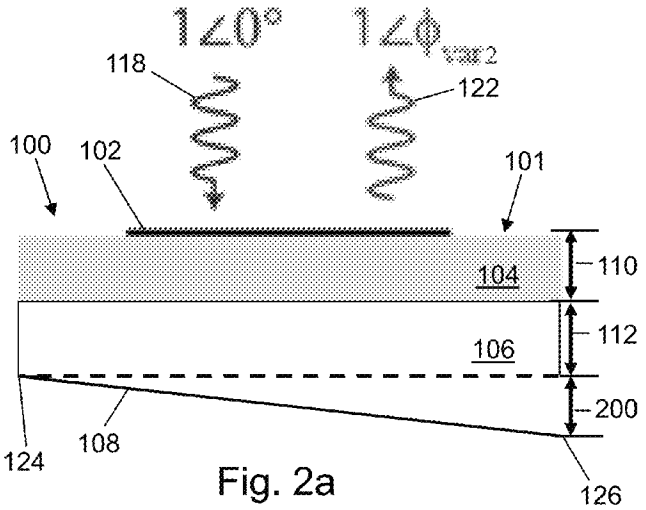

Referring to FIG. 2*a*, tunable phase shifter 100 is shown after movement of only second edge 126 of conducting sheet 108 by an actuator to increase distance 112 by a fourth distance 200. Fourth distance 200 is selected to generate the differential phase change $\Phi_{var2}-\Phi_{var1}$ based on the movement of conducting sheet 108 to the tilted position shown. An actuator may not be needed at first edge 124.

Referring to FIG. 2*b*, tunable phase shifter 100 is shown after movement of only second edge 126 of conducting sheet 108 to increase distance 112 by a fifth distance 202. Fifth distance 202 is selected to generate the differential phase change $\Phi_{var3}-\Phi_{var1}$ based on the movement of conducting sheet 108 to the second tilted position shown.

Figure 2C:
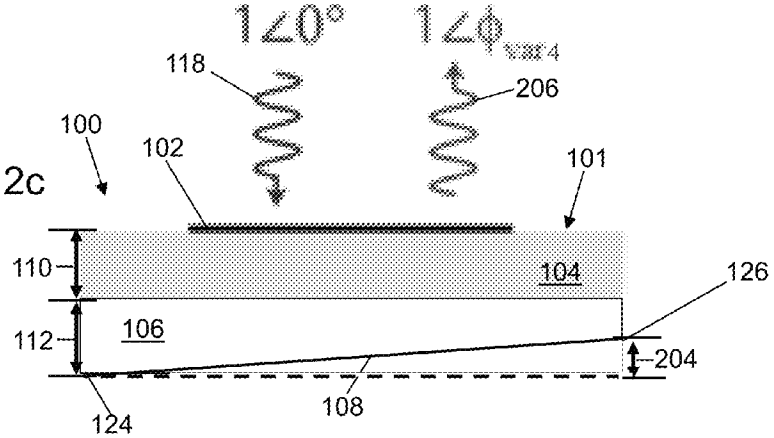

Referring to FIG. 2*c*, tunable phase shifter 100 is shown after movement of only second edge 126 of conducting sheet 108 to decrease distance 112 by a sixth distance 204. Electromagnetic wave 118 received by tunable phase shifter 100 is reflected by conducting sheet 108 back through spatial phase shift element 101 resulting in a change in phase $\Phi_{var4}$ of a fourth reflected electromagnetic wave 206 relative to electromagnetic wave 118. Sixth distance 204 is selected to generate a differential phase change $\Phi_{var4}-\Phi_{var1}$ relative to the configuration shown in FIG. 1*a* based on the movement of conducting sheet 108 to the third tilted position shown.

Figure 3:
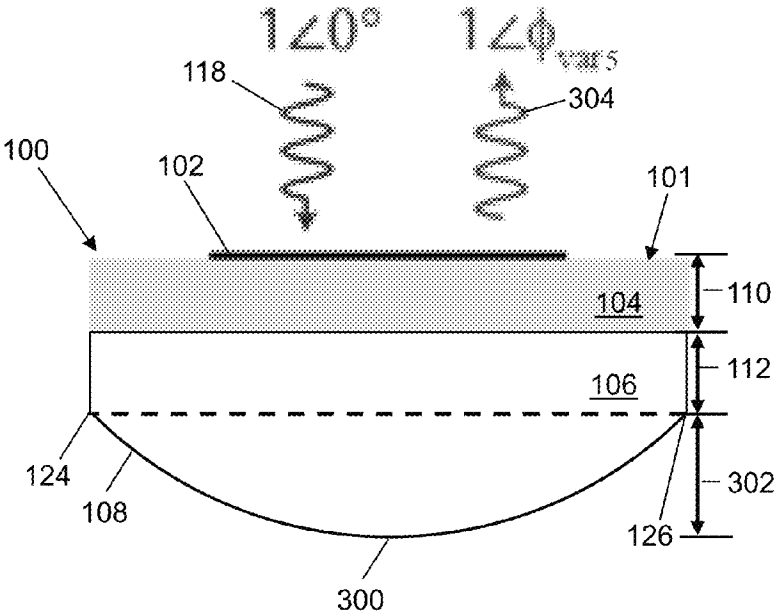
FIG. 3 depicts a side view of a third tunable phase shifter in accordance with an illustrative embodiment with a conducting sheet moved to a deflected position.

Referring to FIG. 3, tunable phase shifter 100 is shown after movement of a center 300 of conducting sheet 108 by an actuator to increase distance 112 by a seventh distance 302. Electromagnetic wave 118 received by tunable phase shifter 100 is reflected by conducting sheet 108 back through spatial phase shift element 101 resulting in a change in phase $\Phi_{var5}$ of a fifth reflected electromagnetic wave 304 relative to electromagnetic wave 118. Seventh distance 302 is selected to generate a differential phase change $\Phi_{var5}-\Phi_{var1}$ relative to the configuration shown in FIG. 1*a* based on the movement of conducting sheet 108 to form a concave shape. Conducting sheet 108 may be formed of a flexible membrane that can be deflected at center 300, at first edge 124, and/or at second edge 126 under control of one or more actuators. Conducting sheet 108 may be anchored at first edge 124 and/or at second edge 126. For example, if conducting sheet 108 has one anchor point at first edge 124, conducting sheet 108 may be bent like a cantilever at second edge 126 to change a distance from spatial phase shift element 101. For example, the separation distance between conducting sheet 108 and a bottom side of dielectric substrate 104 can be changed by changing an applied bias voltage to a piezoelectric actuator.

Figure 4:
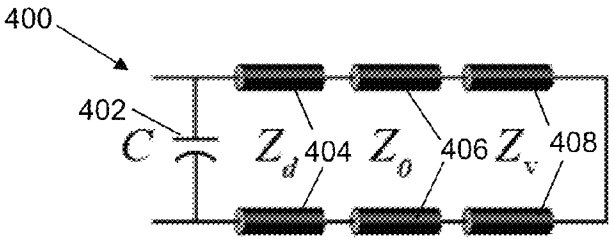
FIG. 4 depicts an equivalent circuit model of the tunable phase shifters of FIGS. 1*a*-1*c*, 2*a*-2*c*, and 3 in accordance with an illustrative embodiment.

In its simplest form, conductive antenna element 102 includes a sub-wavelength capacitive patch placed on dielectric substrate 104. Referring to FIG. 4, an equivalent circuit model 400 of tunable phase shifter 100 with conductive antenna element 102 implemented as a sub-wavelength capacitive patch is shown in accordance with an illustrative embodiment. Equivalent circuit model 400 may include a capacitive element 402, a first transmission line element 404, a second transmission line element 406, and a third transmission line element 408. Capacitive element 402 may be associated with conductive antenna element 102 implemented as a sub-wavelength capacitive patch. First transmission line element 404 may be associated with a characteristic impedance $Z_d$ resulting from thickness 110 selected for dielectric substrate 104. Second transmission line element 406 may be associated with a characteristic impedance $Z_0$ resulting from distance 112 between conducting sheet 108 and a bottom of dielectric substrate 104. Third transmission line element 408 may be short-circuited and associated with a characteristic impedance $Z_v$ resulting from movement between conducting sheet 108 and spatial dielectric substrate 104 relative to distance 112.

Figure 5:
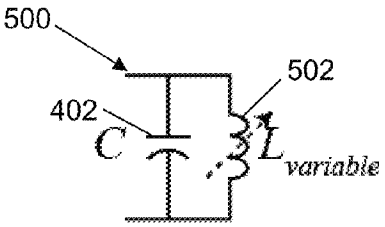
FIG. 5 depicts a simplified equivalent circuit model of the tunable phase shifters of FIGS. 1*a*-1*c*, 2*a*-2*c*, and 3 in accordance with an illustrative embodiment.

Referring to FIG. 5, a simplified equivalent circuit model 500 of equivalent circuit model 400 is shown in accordance with an illustrative embodiment. The short-circuited first transmission line element 404, second transmission line element 406, and third transmission line element 408 have been combined into a single transmission line with a variable length that is short-circuited on one end. If the length of this short-circuited transmission line is less than a quarter wavelength, the single transmission line acts as a variable inductor 502. Simplified equivalent circuit model 500 forms a parallel LC resonant circuit. To an incident electromagnetic wave, such as electromagnetic wave 118, tunable phase shifter 100 acts as a distributed resonator where the capacitive patch acts as a capacitor of the parallel LC resonant circuit and dielectric substrate 104 backed by conducting sheet 108 forming a ground plane acts as variable inductor 502 of the parallel LC resonant circuit. At a frequency where the L and C resonate, the incident electromagnetic (EM) wave experiences a reflection coefficient of +1 (i.e., magnitude of 1 and a phase of 0 degrees). However, if the frequency of the incident EM wave is above or below the resonant frequency of the LC resonator, the reflection coefficient is $1\angle\phi$, where the magnitude of the reflection coefficient remains one, but the phase is $\phi$ so that tunable phase shifter 100 can be designed by changing variable inductor 502 and the resulting resonant frequency to provide a desired phase shift value at the selected frequency(ies) of operation. Thus, a frequency response of tunable phase shifter 100 can be changed by changing the value of the inductor, L. Specifically, when impedance $Z_v$ is changed, the phase of the reflection coefficient is changed. The value of the inductor, L, can be changed by changing a distance between conducting sheet 108 and spatial phase shift element 101 relative to distance 112.

Figure 6:
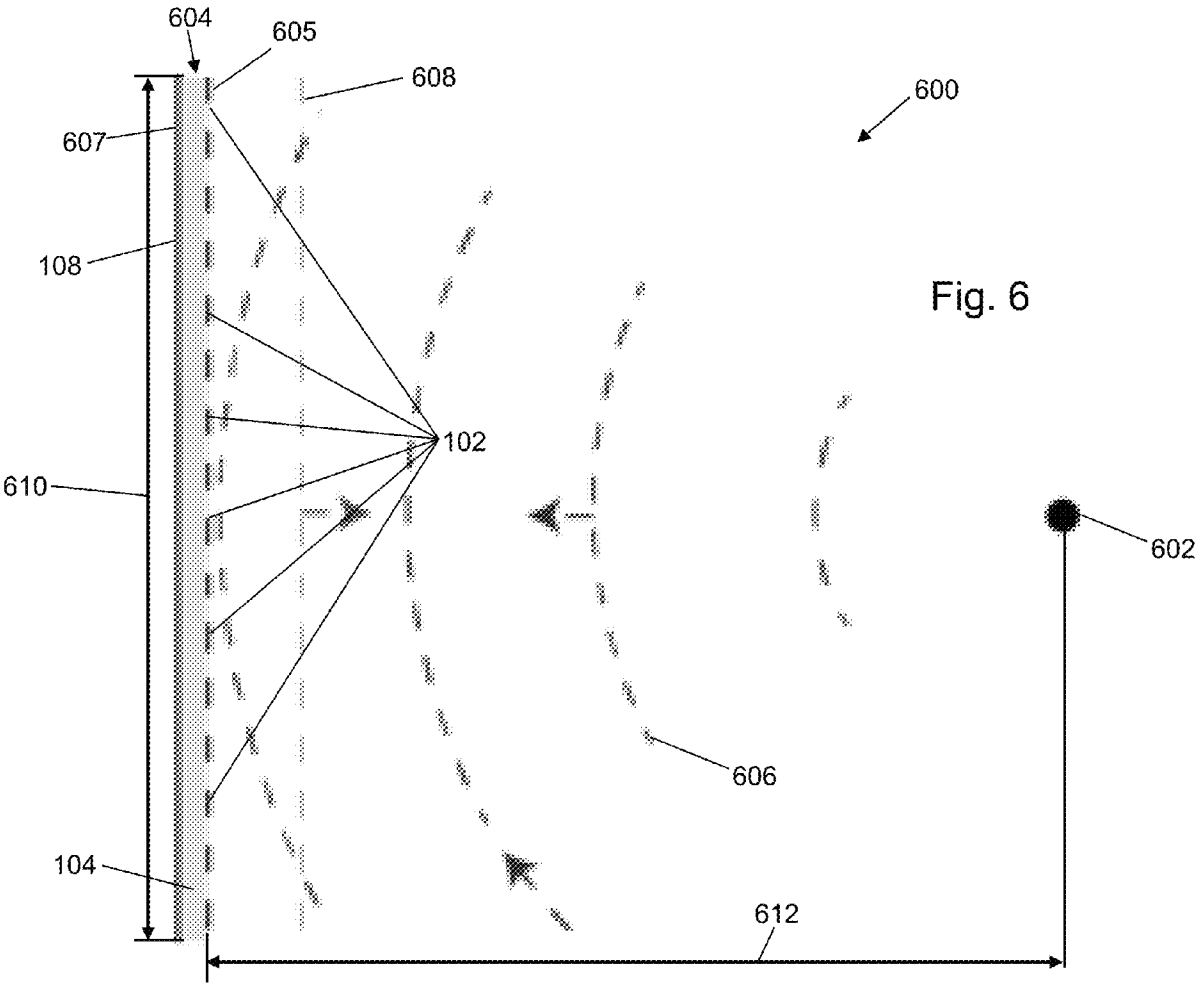
FIG. 6 depicts a side view of a transmitter in accordance with an illustrative embodiment.

Referring to FIG. 6, a one-dimensional (1-D) side view of a transmitter 600 is shown in accordance with an illustrative embodiment. Transmitter 600 may include a feed antenna 602 and a plurality of tunable phase shifters 604. As understood by a person of skill in the art, the wavelength of operation $\lambda_c$ of transmitter 600 is defined as $\lambda_c=c/f_c$, where c is the speed of light and $f_c$ is a carrier frequency. As an example, for $f_c \in [1, 15]$ Gigahertz (GHz), $\lambda_c \in [30,2]$ centimeters (cm).

Feed antenna 602 may have a low-gain. Feed antenna 602 may be a dipole antenna, a monopole antenna, a helical antenna, a microstrip antenna, a patch antenna, a fractal antenna, a feed horn, a slot antenna, an end fire antenna, a parabolic antenna, etc. Feed antenna 602 is positioned a focal distance 612, $f_d$, from a front face 605 of the plurality of tunable phase shifters 604. Feed antenna 602 is configured to receive an analog or digital signal, and in response, to radiate a spherical radio wave 606 toward front face 605 of the plurality of tunable phase shifters 604.

In the illustrative embodiment of FIG. 6, the plurality of tunable phase shifters 604 is distributed linearly in a vertical direction. The plurality of tunable phase shifters 604 include a plurality of conductive antenna elements 102 arranged on front face 605 and mounted on dielectric substrate 104. Conductive sheet 108 is positioned on a back face 607 of the plurality of tunable phase shifters 604 that is opposite front face 605. The plurality of tunable phase shifters 604 may be arranged to form a one-dimensional (1D) or a two-dimensional (2D) array of spatial phase shift elements in any direction. The plurality of tunable phase shifters 604 may form variously shaped apertures including circular, rectangular, square, elliptical, etc. The plurality of tunable phase shifters 604 can include any number of tunable phase shifters.

Each tunable phase shifter 100 of the plurality of tunable phase shifters 604 includes an embodiment of tunable phase shifter 100 structured to generate a defined phase shift on an incident electromagnetic wave. For example, referring to FIG. 8, a perspective view of transmitter 600 is shown. Feed antenna 602 is illustrated as a feed horn. The plurality of tunable phase shifters 604 are arranged to form a circular 2D array of tunable phase shifters 100. Each tunable phase shifter of the plurality of tunable phase shifters 604 may be designed to generate a different phase shift. The plurality of tunable phase shifters 604 has an aperture length 610, D.

Though transmitter 600 is described as transmitting electromagnetic waves, as understood by a person of skill in the art, transmitter 600 may be a transceiver and configured to both send and receive electromagnetic waves. Additionally, a receiver system may use a similar architecture as that described with reference to transmitter 600 as understood by a person of skill in the art.

Referring again to FIG. 6, as understood by a person of skill in the art, spherical radio wave 606 reaches different portions of front face 605 at different times. The plurality of tunable phase shifters 604 can be considered to be a plurality of pixels each of which act as a phase shift unit by providing a selected phase shift within the frequency band of interest. Thus, each tunable phase shifter 100 of the plurality of tunable phase shifters 604 acts as a phase shift circuit selected such that spherical radio wave 606 is re-radiated in the form of a planar wave 608 that is parallel to front face 605. Given aperture length 610 and focal distance 612, the phase shift profile provided for the plurality of tunable phase shifters 604 to form planar wave 608 can be calculated.

For example, assuming feed antenna 602 is aligned to emit spherical radio wave 606 at the focal point of the plurality of tunable phase shifters 604, the time it takes for each ray to arrive at front face 605 is determined by a length of each ray trace, i.e., the distance traveled by the electromagnetic wave traveling at the speed of light. A minimum time corresponds to a propagation time of the shortest ray trace, which is the line path from feed antenna 602 to a center of front face 605. A maximum time corresponds to a propagation time of the longest ray trace, which is the line path from feed antenna 602 to an edge of front face 605. Feed antenna 602 may be positioned at an off-center position with a resulting change in the distribution of ray traces to each tunable phase shifter.

Figure 7:
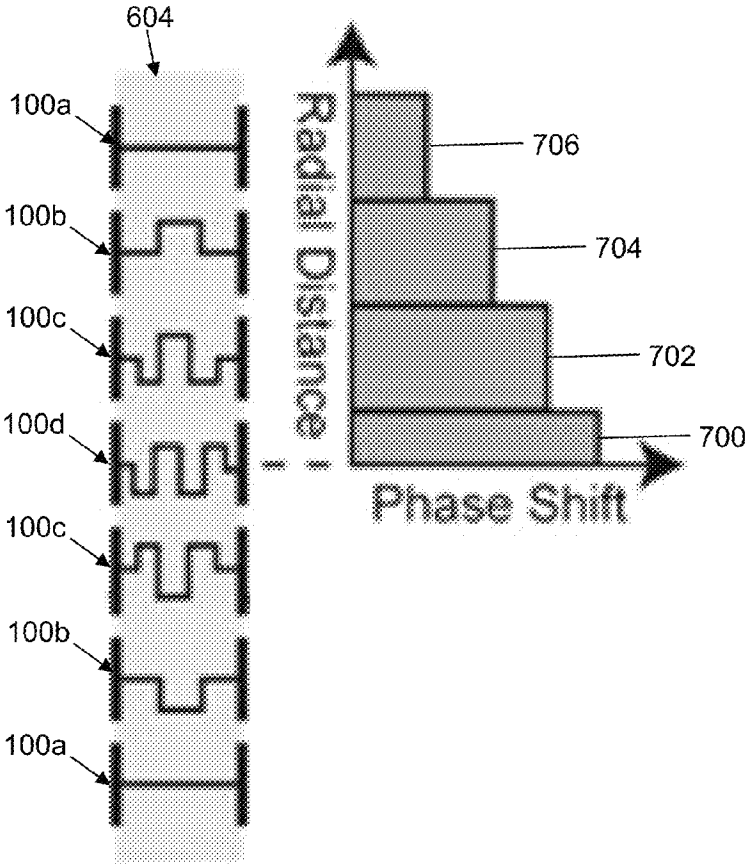
FIG. 7 depicts a side view of a plurality of tunable phase shifters in accordance with an illustrative embodiment.

To achieve beam collimation and form planar wave 608, each tunable phase shifter of the plurality of tunable phase shifters 604 provides a reverse phase shift profile. For example, referring to FIG. 7, the plurality of tunable phase shifters 604 include a first tunable phase shifter 100*a*, a second tunable phase shifter 100*b*, a third tunable phase shifter 100*c*, and a fourth tunable phase shifter 100*d*. An embodiment of first tunable phase shifter 100*a* is positioned at a top and a bottom of the plurality of tunable phase shifters 604. An embodiment of second tunable phase shifter 100*b* is positioned adjacent each embodiment of first tunable phase shifter 100*a*. An embodiment of third tunable phase shifter 100*c* is positioned adjacent each embodiment of second tunable phase shifter 100*b* on a side opposite first tunable phase shifter 100*a*. Fourth tunable phase shifter 100*d* is positioned at a center of the plurality of tunable phase shifters 604 such that the plurality of tunable phase shifters 604 are arranged symmetrically from top to bottom.

As a result, a phase shift profile has a minimum value 706 at the top/bottom of front face 605, and increases to a maximum value 700 at the center of the plurality of tunable phase shifters 604. Thus, first tunable phase shifter 100*a* generates minimum value 706 of phase shift based on the phase shift needed to collimate the received EM wave. Fourth tunable phase shifter 100*d* generates maximum value 700 of phase shift based on the phase shift needed to collimate the received EM wave. Second tunable phase shifter 100*b* generates a first intermediate value 704 of phase shift, and third tunable phase shifter 100*c* generates a second intermediate value 702 of phase shift. Of course, the phase shift profile may be shifted based on a location of feed antenna 602 relative to front face 605 as understood by a person of skill in the art.

Figure 9:
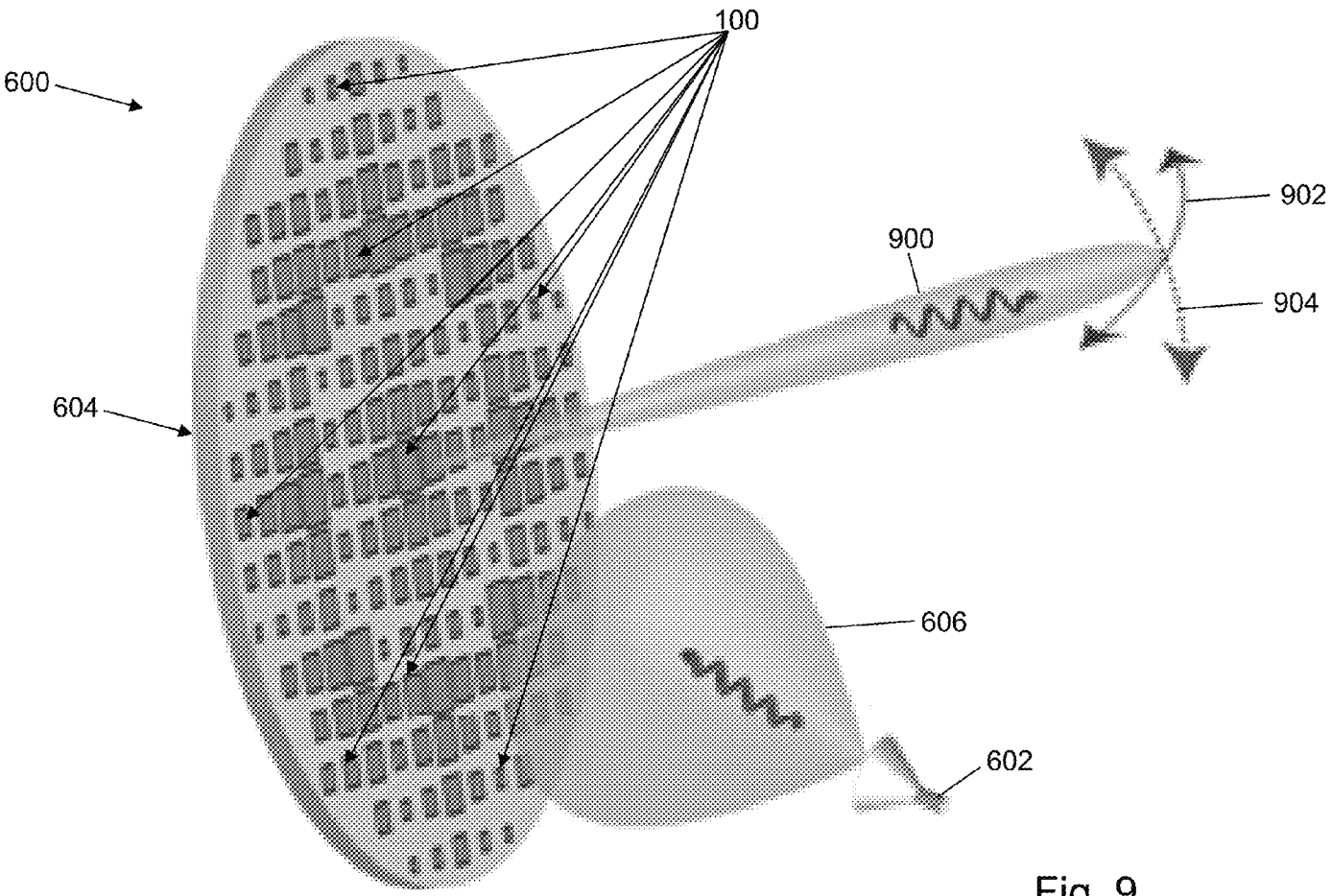
FIG. 9 depicts a perspective view of the transmitter of FIG. 6 with a feed antenna positioned off center relative to the plurality of tunable phase shifters in accordance with an illustrative embodiment.

Referring to FIG. 9, feed antenna 602 may be positioned off center relative to the plurality of tunable phase shifters 604. Additionally, the phase shift profile implemented by each tunable phase shifter 100 of the plurality of tunable phase shifters 604 may be designed to radiate a high gain pencil beam 900 in a variable direction. In a 2D array such as that illustrated, the direction may vary in a horizontal direction 902 and in a vertical direction 904.

Figure 10:
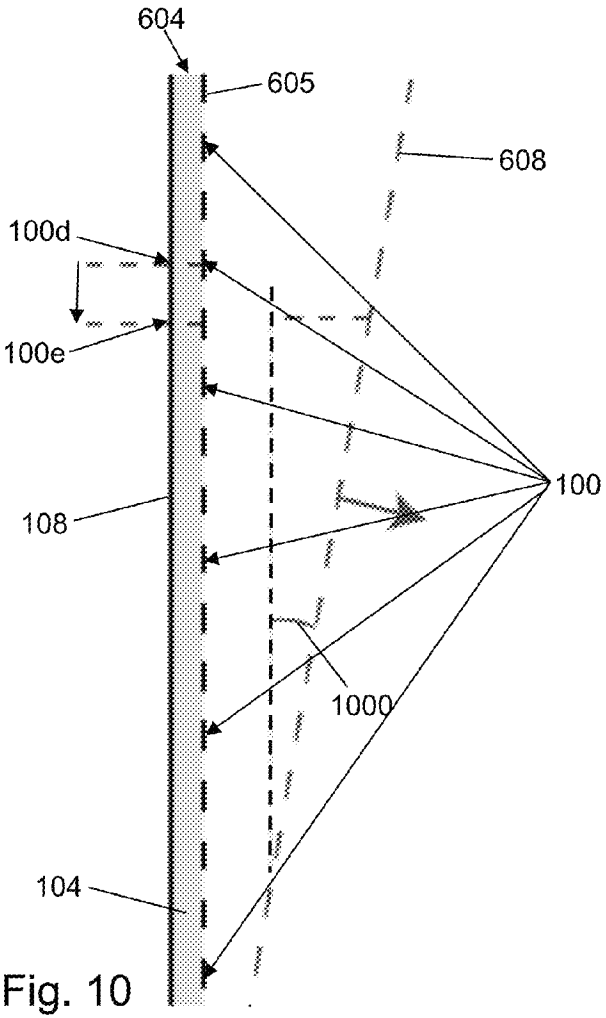
FIG. 10 depicts a side view of the plurality of tunable phase shifters of FIG. 6 and a resulting planar, collimated reflected wave in accordance with an illustrative embodiment.

Referring to FIG. 10, if the tunable phase shifters 100 of the plurality of tunable phase shifters 604 are configured to provide a phase shift gradient over the aperture, planar wave 608 is directed towards an angle 1000, θ, with respect to front face 605. The radiated field of transmitter 600 is pointed towards a direction of 90−θ with respect to a vector normal to front face 605. Because the response of the tunable phase shifters 100 is tunable, angle 1000 can be dynamically changed in horizontal direction 902 and/or in vertical direction 904.

To achieve a radiated beam towards angle 1000, two adjacent tunable phase shifters 100, such as fourth tunable phase shifter 100*d* and a fifth tunable phase shifter 100*e*, have a relative phase shift of kd cos θ, where $k=2\pi/\lambda_c$ is a wavenumber and d is a spacing between the adjacent tunable phase shifters 100. As discussed relative to FIGS. 1*a*-1*c*, 2*a*-2*c* and 3, the phase shift of each tunable phase shifter 100 can be controlled by changing a distance between conducting sheet 108 relative to spatial phase shift element 101. The tunable phase shifters 100 of the plurality of tunable phase shifters 604 locally manipulate the phase-front of the incident EM wave and convert spherical wave 606 radiated by feed antenna 602 to planar wave 608 pointed in direction θ.

The combination of feed antenna 602 and the plurality of tunable phase shifters 604 form a high-gain antenna. A direction of maximum radiation of the high-gain antenna is determined by the phase shift gradient of the electric field distribution over the aperture of the plurality of tunable phase shifters 604. Because the phase shift gradient is dynamically changeable by changing the distance between conducting sheet 108 relative to spatial phase shift element 101, the direction of maximum radiation of the antenna also changes. Such a dynamically reconfigurable system constitutes a beam steerable phased array.

Because the phase shift gradient over the aperture of the plurality of tunable phase shifters 604 is a continuous function, a simple continuous tiltable conducting sheet can be used to produce the phase shift gradient. For example, referring to FIG. 11, a first plurality of tunable phase shifters 604*a* includes a first tunable phase shifter 100*a*, a second tunable phase shifter 100*b*, a third tunable phase shifter 100*c*, a fourth tunable phase shifter 100*d*, a fifth tunable phase shifter 100*e*, a sixth tunable phase shifter 100*f*, a seventh tunable phase shifter 100*g*, an eighth tunable phase shifter 100*h*, a ninth tunable phase shifter 100*i*, a tenth tunable phase shifter 100*j*, an eleventh tunable phase shifter 100*k*, a twelfth tunable phase shifter 100*l*, a thirteenth tunable phase shifter 100*m*, and a fourteenth tunable phase shifter 100*n*. The first plurality of tunable phase shifters 604*a* may be implemented in two dimensions though only one dimension is illustrated for simplicity.

First tunable phase shifter 100*a* includes a first conductive antenna element 102*a*; second tunable phase shifter 100*b* includes a second conductive antenna element 102*b*; third tunable phase shifter 100*c* includes a third conductive antenna element 102*c*; fourth tunable phase shifter 100*d* includes a fourth conductive antenna element 102*d*; fifth tunable phase shifter 100*e* includes a fifth conductive antenna element 102*e*; sixth tunable phase shifter 100*f* includes a sixth conductive antenna element 102*f*; seventh tunable phase shifter 100*g* includes a seventh conductive antenna element 102*g*; eighth tunable phase shifter 100*h* includes an eighth conductive antenna element 102*h*; ninth tunable phase shifter 100*i* includes a ninth conductive antenna element 102*i*; tenth tunable phase shifter 100*j* includes a tenth conductive antenna element 102*j*; eleventh tunable phase shifter 100*k* includes an eleventh conductive antenna element 102*k*; twelfth tunable phase shifter 100*l* includes a twelfth conductive antenna element 102*l*; thirteenth tunable phase shifter 100*m* includes a thirteenth conductive antenna element 102*m*; and fourteenth tunable phase shifter 100*n* includes a fourteenth conductive antenna element 102*n*.

Each conductive antenna element 102*a*-102*n* is mounted on dielectric substrate 104. For illustration, each conductive antenna element 102*a*-102*n* may be a capacitive patch placed on the same dielectric substrate 104. Each capacitive patch may have different dimensions to change a capacitive value of the capacitor of the parallel LC resonant circuit of simplified equivalent circuit model 500 to define a phase shift that varies across the aperture to create planar wave 608 that is parallel to front face 605 when conducting sheet 108 is positioned in line with the dashed line. Planar wave 608 defines a pencil beam in a direction of a normal vector 1106 that is normal to front face 605 conducting sheet 108 is positioned in line with the dashed line. Spacer 106 separates dielectric substrate 104 from conducting sheet 108 to mount conducting sheet 108 the distance 112 from dielectric substrate 104. Conducting sheet 108 is continuous and common to each conductive antenna element 102*a*-102*n*. Conducting sheet 108 has a first edge 1102 and a second edge 1104 opposite the first edge 1102. First edge 1102 is an outside edge of conducting sheet 108 associated with first tunable phase shifter 100*a*. Second edge 1104 is an outside edge of conducting sheet 108 associated with fourteenth tunable phase shifter 100*n*.

Figure 11:
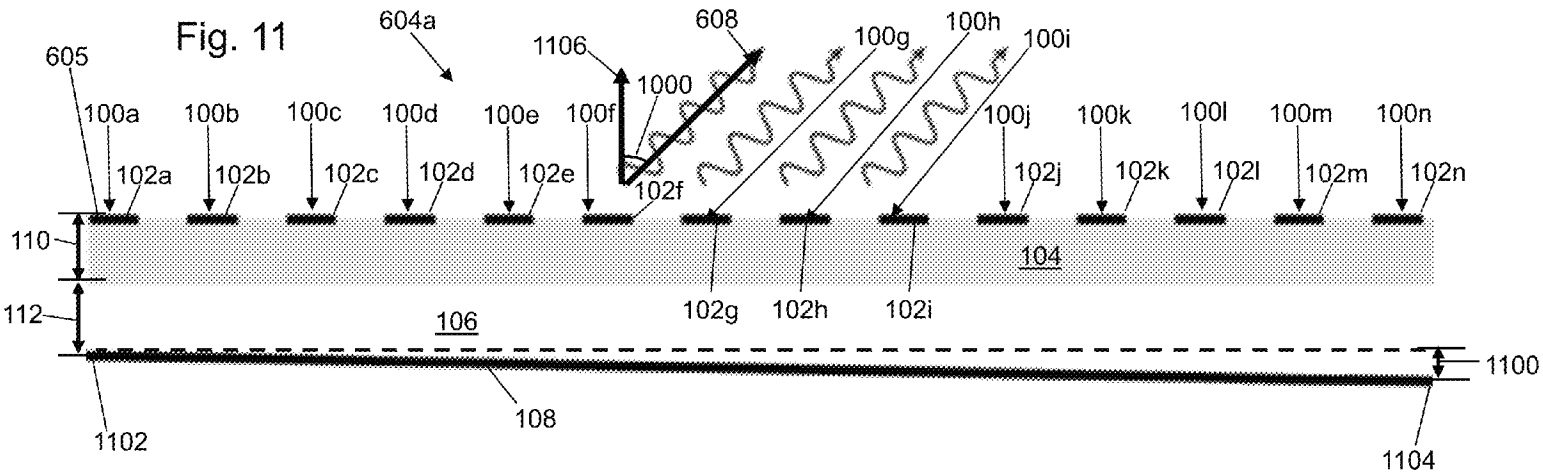
FIG. 11 depicts a plurality of tunable phase shifters in accordance with a first illustrative embodiment.

In the illustrative embodiment of FIG. 11, an actuator is mounted to second edge 1104 to tilt conducting sheet 108 a tilt distance 1100 relative to distance 112 at second edge 1104. The distance between conducting sheet 108 and a bottom of dielectric substrate 104 varies continuously from distance 112 at first edge 1102 to distance 112 plus tilt distance 1100 at second edge 1104 thereby producing a phase shift gradient that radiates planar wave 608 at angle 1000 with respect to normal vector 1106. By adjusting tilt distance 1100, angle 1000 can be changed to steer planar wave 608 in a specific direction thereby allowing electronic beam steering.

A phase shift gradient is created that results in a maximum phase shift provided by first tunable phase shifter 100*a*, and a minimum phase shift provided by fourteenth tunable phase shifter 100*n*. The phase shift gradient is approximately continuous over the aperture. As a result, an approximately continuous phase shift is created. The direction of maximum radiation can be dynamically changed by changing a direction and a magnitude of the phase shift gradient by adjusting the slope of conducting sheet 108.

Figure 12:
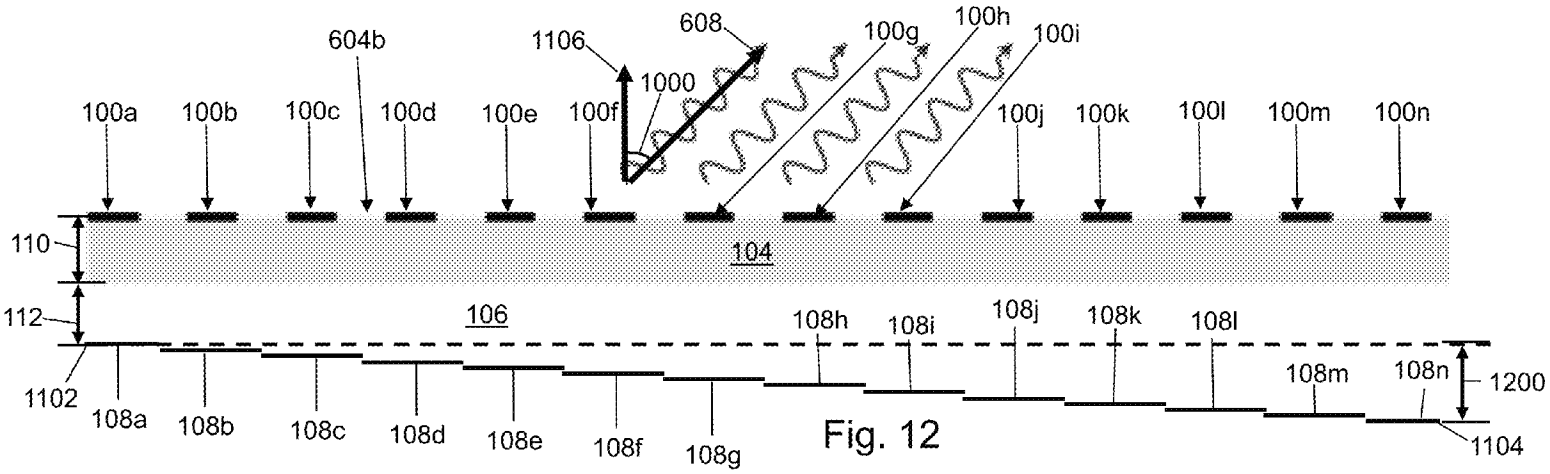
FIG. 12 depicts a plurality of tunable phase shifters in accordance with a second illustrative embodiment.

As another example, referring to FIG. 12, a second plurality of tunable phase shifters 604*b* is shown in accordance with an illustrative embodiment. The second plurality of tunable phase shifters 604*b* differs from the first plurality of tunable phase shifters 604*a* in that conducting sheet 108 is discontinuous at each edge of each tunable phase shifter 100*a*-100*n*. The second plurality of tunable phase shifters 604*b* can be made individually tunable by changing the distance to their respective ground planes (conducting sheets) individually. Conducting sheet 108 is divided into a plurality of sections that are independently moveable with one section for each tunable phase shifter 100. First tunable phase shifter 100*a* includes a first conducting sheet element 108*a*; second tunable phase shifter 100*b* includes a second conducting sheet element 108*b*; third tunable phase shifter 100*c* includes a third conducting sheet element 108*c*; fourth tunable phase shifter 100*d* includes a fourth conducting sheet element 108*d*; fifth tunable phase shifter 100*e* includes a fifth conducting sheet element 108*e*; sixth tunable phase shifter 100*f* includes a sixth conducting sheet element 108*f*; seventh tunable phase shifter 100*g* includes a seventh conducting sheet element 108*g*; eighth tunable phase shifter 100*h* includes an eighth conducting sheet element 108*h*; ninth tunable phase shifter 100*i* includes a ninth conducting sheet element 108*i*; tenth tunable phase shifter 100*j* includes a tenth conducting sheet element 108*j*; eleventh tunable phase shifter 100*k* includes an eleventh conducting sheet element 108*k*; twelfth tunable phase shifter 100*l* includes a twelfth conducting sheet element 108*l*; thirteenth tunable phase shifter 100*m* includes a thirteenth conducting sheet element 108*m*; and fourteenth tunable phase shifter 100*n* includes a fourteenth conducting sheet element 108*n*.

First edge 1102 is an outside edge of first conducting sheet element 108*a* associated with first tunable phase shifter 100*a*. Second edge 1104 is an outside edge of fourteenth conducting sheet element 108*n* associated with fourteenth tunable phase shifter 100*n*. In the illustrative embodiment of FIG. 12, an actuator may be mounted to each edge of each conducting sheet element 108*a*-108*n* to provide a stepped slope of conducting sheet 108 to an overall tilt distance 1200 relative to distance 112 at second edge 1104. Of course, first conducting sheet element 108*a* may not need actuators if it is not moved. The distance between conducting sheet 108 and a bottom of dielectric substrate 104 varies in steps from distance 112 at first edge 1102 to distance 112 plus overall tilt distance 1200 at second edge 1104 thereby producing a phase shift gradient that radiates planar wave 608 at angle 1000 with respect to normal vector 1106. By adjusting individual distances between each conducting sheet element 108*a*-108*n* and dielectric substrate 104 to achieve overall tilt distance 1200 at fourteenth conducting sheet element 108*n*, angle 1000 can be changed to steer planar wave 608 in a specific direction thereby allowing electronic beam steering. Again, a phase shift gradient is created that results in a maximum phase shift provided by first tunable phase shifter 100*a*, and a minimum phase shift provided by fourteenth tunable phase shifter 100*n*. The direction of maximum radiation can be dynamically changed by changing a direction and a magnitude of the phase shift gradient by adjusting the slope of conducting sheet 108.

Figure 13:
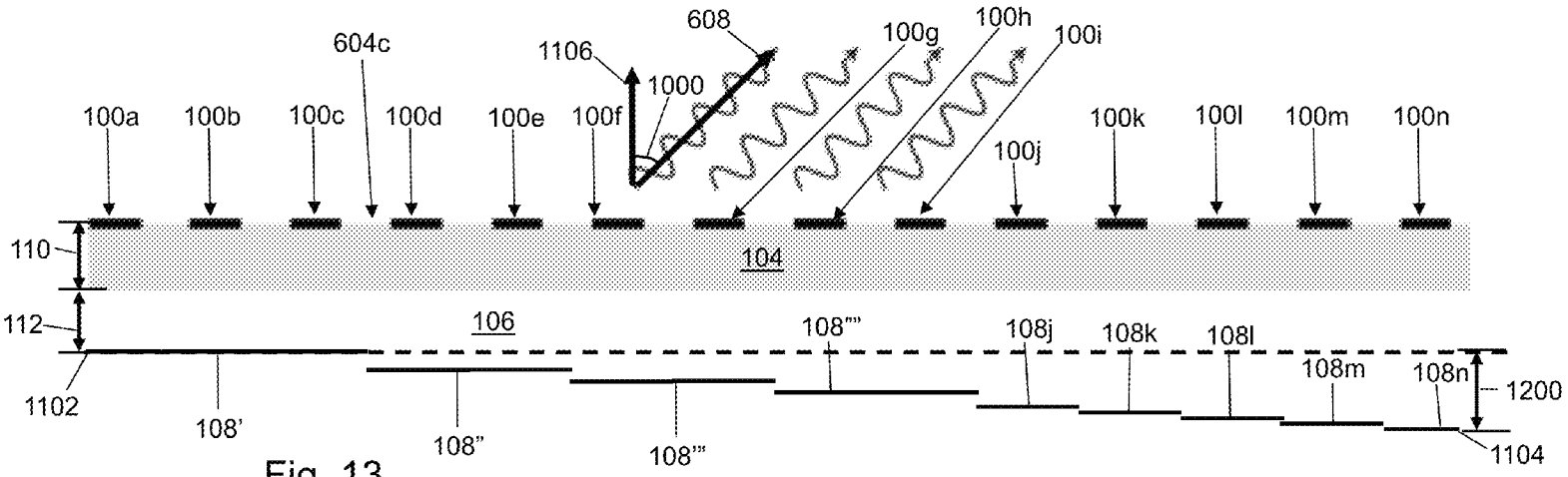
FIG. 13 depicts a plurality of tunable phase shifters in accordance with a third illustrative embodiment.

As yet another example, referring to FIG. 13, a third plurality of tunable phase shifters 604*c* is shown in accordance with an illustrative embodiment. The third plurality of tunable phase shifters 604*c* differs from the second plurality of tunable phase shifters 604*b* in that conducting sheet 108 is discontinuous though not at each edge of each tunable phase shifter 100*a*-100*n*. Conducting sheet 108 is divided into a plurality of sections that are independently moveable with one section for one or more tunable phase shifters 100. For example, first tunable phase shifter 100*a*, second tunable phase shifter 100*b*, and third tunable phase shifter 100*c* include a first conducting sheet element 108'; fourth tunable phase shifter 100*d* and fifth tunable phase shifter 100*e* include a second conducting sheet element 108"; sixth tunable phase shifter 100*f* and seventh tunable phase shifter 100*g* include a third conducting sheet element 108'''; eighth tunable phase shifter 100*h* and ninth tunable phase shifter 100*i* include a third conducting sheet element 108''''; whereas, tenth tunable phase shifter 100*j* includes tenth conducting sheet element 108*j*; eleventh tunable phase shifter 100*k* includes eleventh conducting sheet element 108*k*; twelfth tunable phase shifter 100*l* includes twelfth conducting sheet element 108*l*; thirteenth tunable phase shifter 100*m* includes thirteenth conducting sheet element 108*m*; and fourteenth tunable phase shifter 100*n* includes fourteenth conducting sheet element 108*n*. The third plurality of tunable phase shifters 604*c* can be made tunable in sections by changing the distance to their respective ground planes (conducting sheets) as a section.

In the illustrative embodiment of FIG. 13, an actuator may be mounted to each edge of each conducting sheet element 108', 108", 108''', 108'''', 108*j*-108*n* to provide a stepped slope of conducting sheet 108 to overall tilt distance 1200 relative to distance 112 at second edge 1104. Thus, overall tilt distance 1200 at fourteenth conducting sheet element 108*n* is achieved with fewer step changes between first edge 1102 and second edge 1104. Of course, tunable phase shifters 100*a*-100*n* may be grouped in other manners. Again, a phase shift gradient is created that results in a maximum phase shift provided by first tunable phase shifter 100*a*, and a minimum phase shift provided by fourteenth tunable phase shifter 100*n*. The direction of maximum radiation can be dynamically changed by changing a direction and a magnitude of the phase shift gradient by adjusting the slope of conducting sheet 108.

Figure 14:
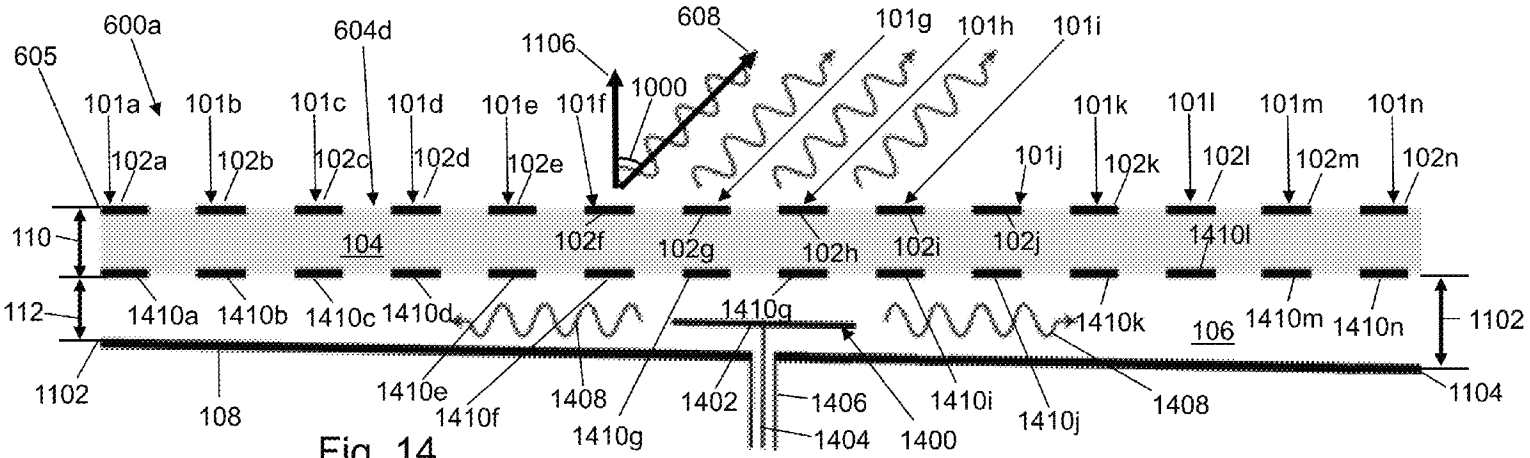
FIG. 14 depicts a plurality of tunable phase shifters in accordance with a fourth illustrative embodiment.

As still another example, referring to FIG. 14, a second transmitter 600*a* is shown in accordance with an illustrative embodiment. Second transmitter 600*a* includes a second feed antenna 1400 and a fourth plurality of tunable phase shifters 604*d*. Second feed antenna 1400 may support surface wave propagation. For example, second feed antenna 1400 may be implemented as a leaky wave antenna. Second feed antenna 1400 may include a patch antenna 1402, an inner conductor 1404 of coaxial cable, and an outer conductor 1406 of the coaxial cable. Inner conductor 1404 is electrically connected to feed patch antenna 1402. Outer conductor 1406 is electrically connected to conducting sheet 108, which may be grounded. For illustration, patch antenna 1402 may be formed of metallic patterns printed on a periodic structure. The metallic patterns can be as simple as rectangular or elliptical metallic patches or more complicated structures such as dipoles, tri-poles, split-ring resonators, etc.

The fourth plurality of tunable phase shifters 604*d* include a plurality of spatial phase shift elements 101*a*-101*n*, spacer 106, and conducting sheet 108. The plurality of spatial phase shift elements 101*a*-101*n* may include dielectric substrate 104, top conductive antenna elements 102*a*-102*n*, and bottom conductive antenna elements 1410*a*-1410*n*. Each of the top conductive antenna elements 102*a*-102*n* and each of the bottom conductive antenna elements 1410*a*-1410*n* are mounted on dielectric substrate 104. For example, a first spatial phase shift element 101*a* includes a first top conductive antenna element 102*a* and a first bottom conductive antenna element 1410*a*. First top conductive antenna element 102*a* is mounted on a top surface of dielectric substrate 104 to form a portion of front face 605, and first bottom conductive antenna element 1410*a* is mounted on a bottom surface of dielectric substrate 104. Spacer 106 is positioned between bottom conductive antenna element 1410*a* and conducting sheet 108. Similarly, second top conductive antenna element 102*b* is mounted on the top surface of dielectric substrate 104, and second bottom conductive antenna element 1410*b* is mounted on the bottom surface of dielectric substrate 104; third top conductive antenna element 102*c* is mounted on the top surface of dielectric substrate 104, and third bottom conductive antenna element 1410*c* is mounted on the bottom surface of dielectric substrate 104, . . . , and fourteenth top conductive antenna element 102*n* is mounted on the top surface of dielectric substrate 104, and fourteenth bottom conductive antenna element 1410*n* is mounted on the bottom surface of dielectric substrate 104.

Figure 15:
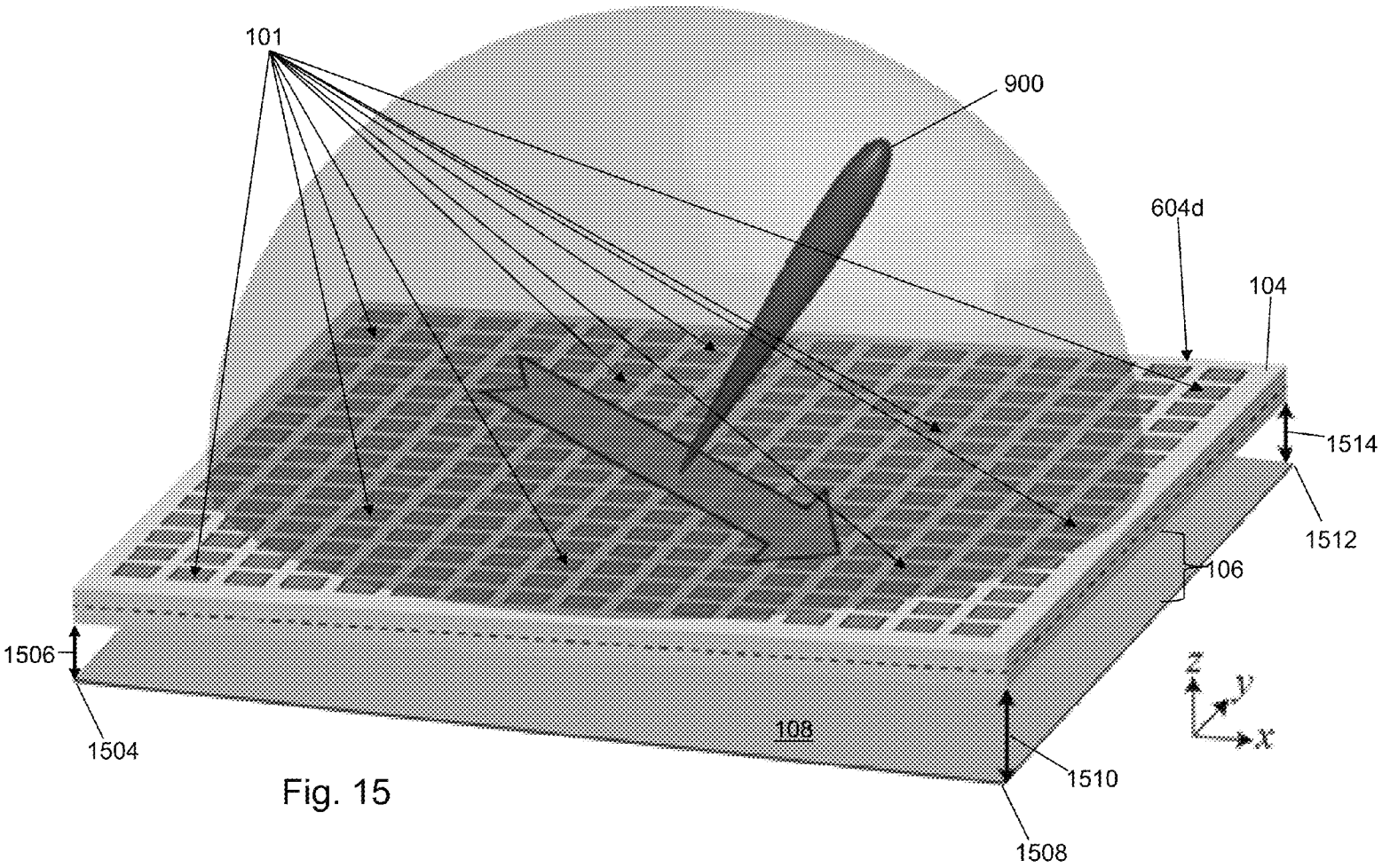
FIG. 15 depicts a plurality of tunable phase shifters in accordance with a fifth illustrative embodiment.

Patch antenna 1402 is positioned within spacer 106. As a surface wave 1408 propagates from patch antenna 1402, surface wave 1408 radiates (leaks) into the space within spacer 106. Surface wave 1408 excites a second surface wave that propagates from second transmitter 600*a*. Second transmitter 600*a* forms a traveling wave antenna where a direction of maximum radiation of the antenna is determined by a propagation constant of the second surface wave. This direction can be changed by dynamically tuning the parameters of the surface waveguide formed by the fourth plurality of tunable phase shifters 604*d*. For example, referring to FIG. 15, the propagation constant of the surface waveguide can be changed by changing a separation between conducting sheet 108 and the plurality of spatial phase shift elements 101. For example, a first corner 1504 may be separated a first corner distance 1506 from the bottom surface of dielectric substrate 104, a second corner 1508 may be separated a second corner distance 1510 from the bottom surface of dielectric substrate 104, and a third corner 1512 may be separated a third corner distance 1514 from the bottom surface of dielectric substrate 104. A fourth corner (not shown) may be fixed at distance 112. A first actuator (not shown) may be mounted to adjust first corner distance 1506, a second actuator (not shown) may be mounted to adjust second corner distance 1510, and a third actuator (not shown) may be mounted to adjust third corner distance 1514. Again, a phase shift gradient is created that results in a maximum phase shift provided by first spatial phase shift element 101*a*, and a minimum phase shift provided by fourteenth spatial phase shift element 101*n*. The direction of maximum radiation can be dynamically changed by changing a direction and a magnitude of the phase shift gradient by adjusting the slope of conducting sheet 108. In alternative embodiments, conducting sheet 108 may be formed of independently movable sections as discussed with reference to FIGS. 12 and 13.

Figure 16:
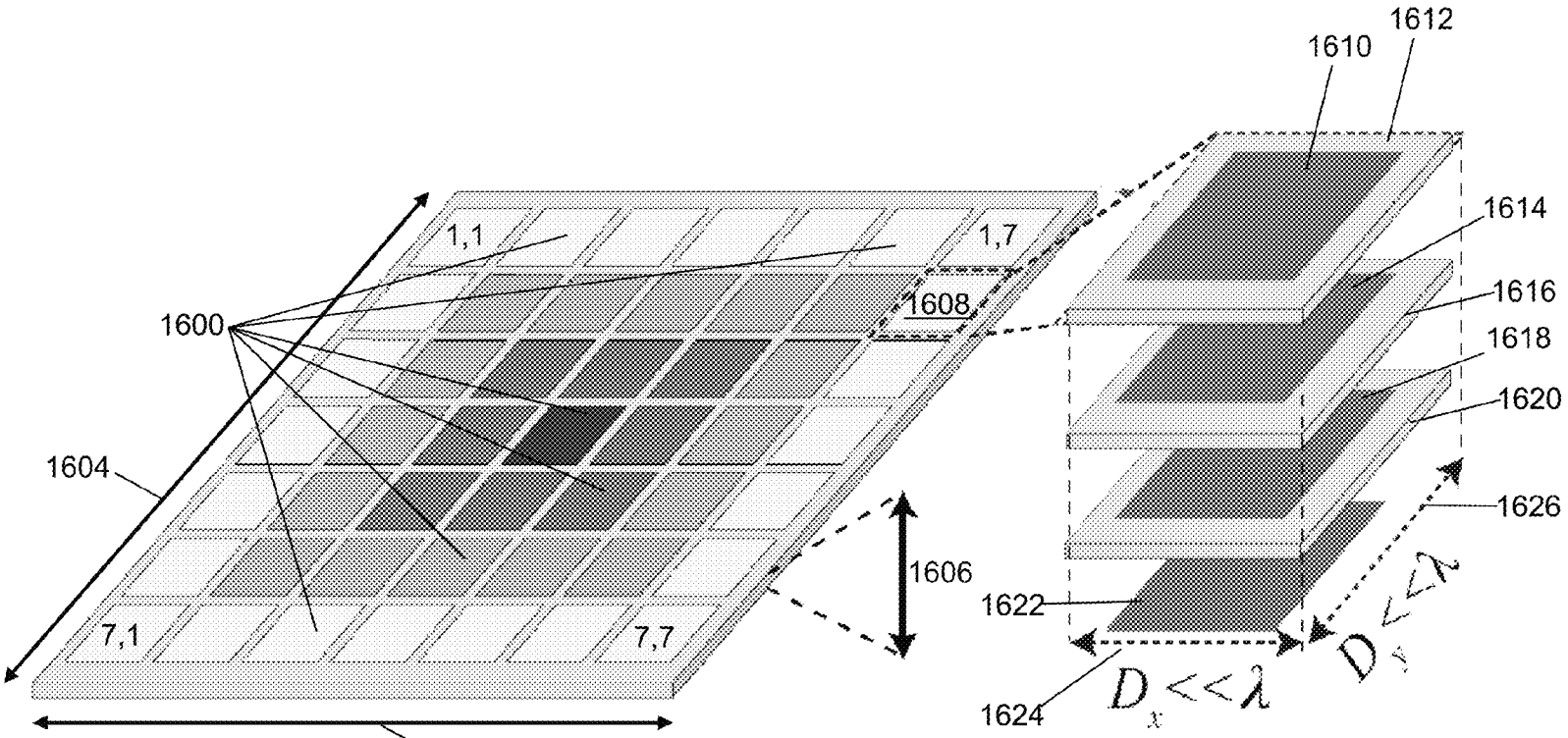
FIG. 16 depicts a plurality of tunable phase shifters in accordance with a sixth illustrative embodiment.

More complicated conductive antenna elements may be used for tunable phase shifter 100. For example, with reference to FIG. 16, a fifth plurality of spatial phase shift elements 1600 is shown in accordance with an illustrative embodiment. In the illustrative embodiment, the spatial phase shift elements 1600 form a 2D rectangular array of 49 spatial phase shift elements. The rectangular array has a width 1602 in an x-direction, a height 1604 in a y-direction, and a depth 1606 in a z-direction. Each spatial phase shift element may be formed of one or more layers of material. For example, spatial phase shift element 101 of FIG. 1*a* is formed of two layers, dielectric substrate 104 and conductive antenna element 102. As another example, spatial phase shift element 101*a* of FIG. 14 is formed of three layers, first top conductive antenna element 102*a*, dielectric substrate 104, and first bottom conductive antenna element 1410*a*.

In an alternative embodiment, each spatial phase shift element may be formed of a greater number of layers of material. For example, referring to FIG. 16, a spatial phase shift element 1608 includes a first capacitive patch 1610 mounted on a first dielectric patch 1612, a second capacitive patch 1614 mounted between first dielectric patch 1612 and a second dielectric patch 1616, a third capacitive patch 1618 mounted between second dielectric patch 1616 and a third dielectric patch 1620, and a fourth capacitive patch 1622 mounted on third dielectric patch 1620 on a side opposite third capacitive patch 1618. Spatial phase shift element 1608 has an element width 1624 in the x-direction, an element height 1626 in the y-direction, and depth 1606 in the z-direction. Element width 1624 and element height 1626 are typically less than a minimum $\lambda_c$ defined for the frequency band of interest. Spatial phase shift element 1608 forms a multi-layered frequency selective surface composed of a number of closely spaced metallic layers separated from one another by dielectric substrates. For example, spatial phase shift element 1608 may be formed by bonding different dielectric substrates together using a bonding film such as a prepreg, which is a reinforcement material pre-impregnated with a polymer or resin matrix in a controlled ratio. Thermosetting polymers/resins solidify by cross-linking to create a permanent network of polymer chains as understood by a person of skill in the art. The dielectric substrates may form a flexible membrane that can be deflected or bent in a manner similar to that described with reference to conducting sheet 108 to allow the dielectric substrate to be moved instead of or in addition to movement of conducting sheet 108.

Figure 17:
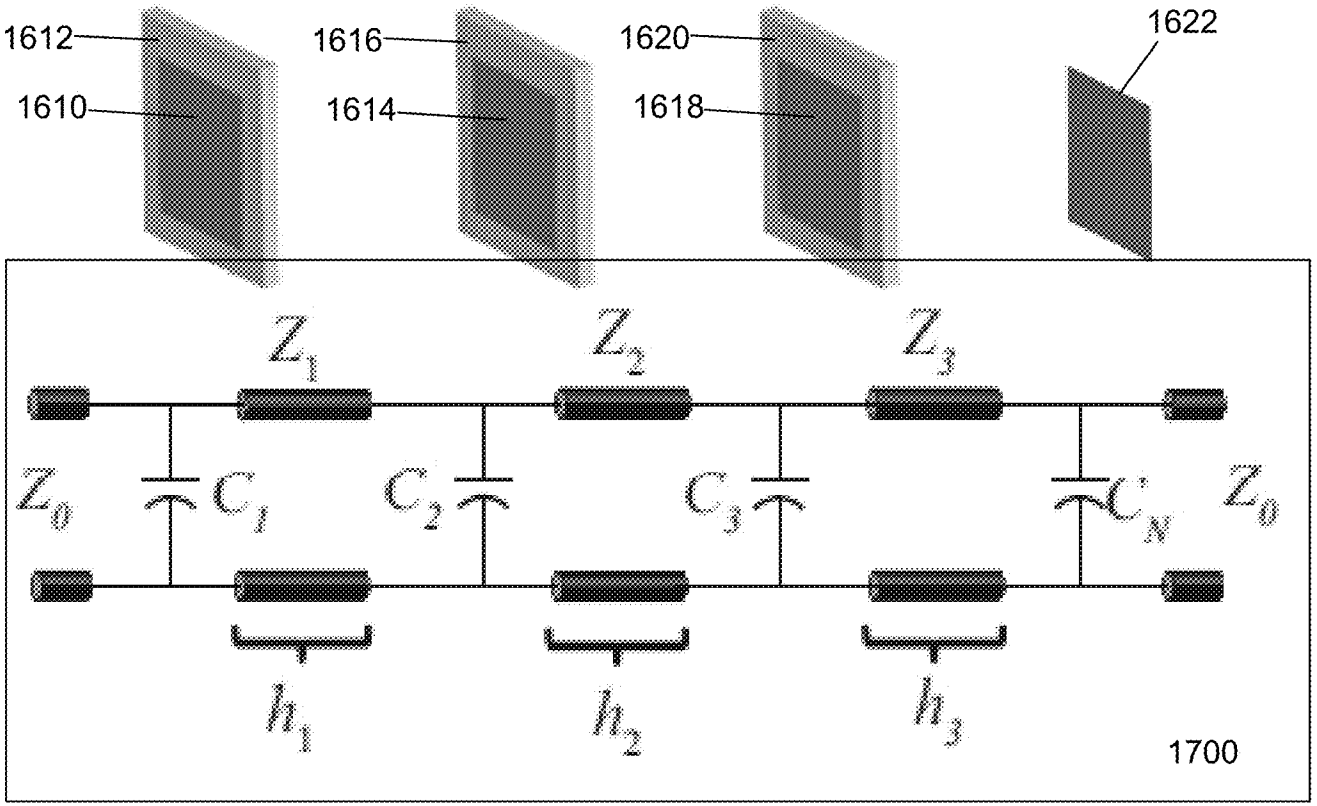
FIG. 17 depicts an equivalent circuit model of a tunable phase shifter of the plurality of tunable phase shifters of FIG. 16 in accordance with an illustrative embodiment.

As discussed above, each spatial phase shift element of the plurality of spatial phase shift elements 1600 forms a phase shift circuit at each grid position based on the selected arrangement of capacitive patch layers and dielectric sheet layers. For example, with reference to FIG. 17, an equivalent circuit 1700 for spatial phase shift element 1608 is shown in accordance with an illustrative embodiment. Equivalent circuit 1700 includes a first capacitor $C_1$ associated with a capacitance created by first capacitive patch 1610, a second capacitor $C_2$ associated with a capacitance created by second capacitive patch 1614, a third capacitor $C_3$ associated with a capacitance created by third capacitive patch 1618, and a fourth capacitor $C_4$ associated with a capacitance created by fourth capacitive patch 1622 arranged in parallel as shunt capacitors.

Equivalent circuit 1700 further includes a first transmission line with characteristic impedance $Z_1$ and length $h_1$ associated with first dielectric patch 1612, a second transmission line with characteristic impedance $Z_2$ and length $h_2$ associated with second dielectric patch 1616, and a third transmission line with characteristic impedance $Z_3$ and length $h_3$ associated with third dielectric patch 1620 arranged in series between the shunt capacitors associated with the adjacent capacitive patch(es). Thus, equivalent circuit 1700 acts as a low pass filter that is implemented by each spatial phase shift element of the plurality of spatial phase shift elements 1600. More specifically, equivalent circuit 1700 acts as a 7th order low pass filter as a result of the number of capacitive patch layers, four, and dielectric sheet layers, three, that form each spatial phase shift element. Equivalent circuit 1700 may replace capacitive element 402 of simplified equivalent circuit 500 of FIG. 5 to design tunable phase shifter 100.

To achieve different phase shifts over the desired frequency range, the plurality of spatial phase shift elements 1600 can be designed to have linear transmission phases with different slopes. The steeper the slope of the transmission phase, the larger the phase shift it will provide. The group delay is determined by several factors including both the order of the filter and the fractional bandwidth.

Figure 18:
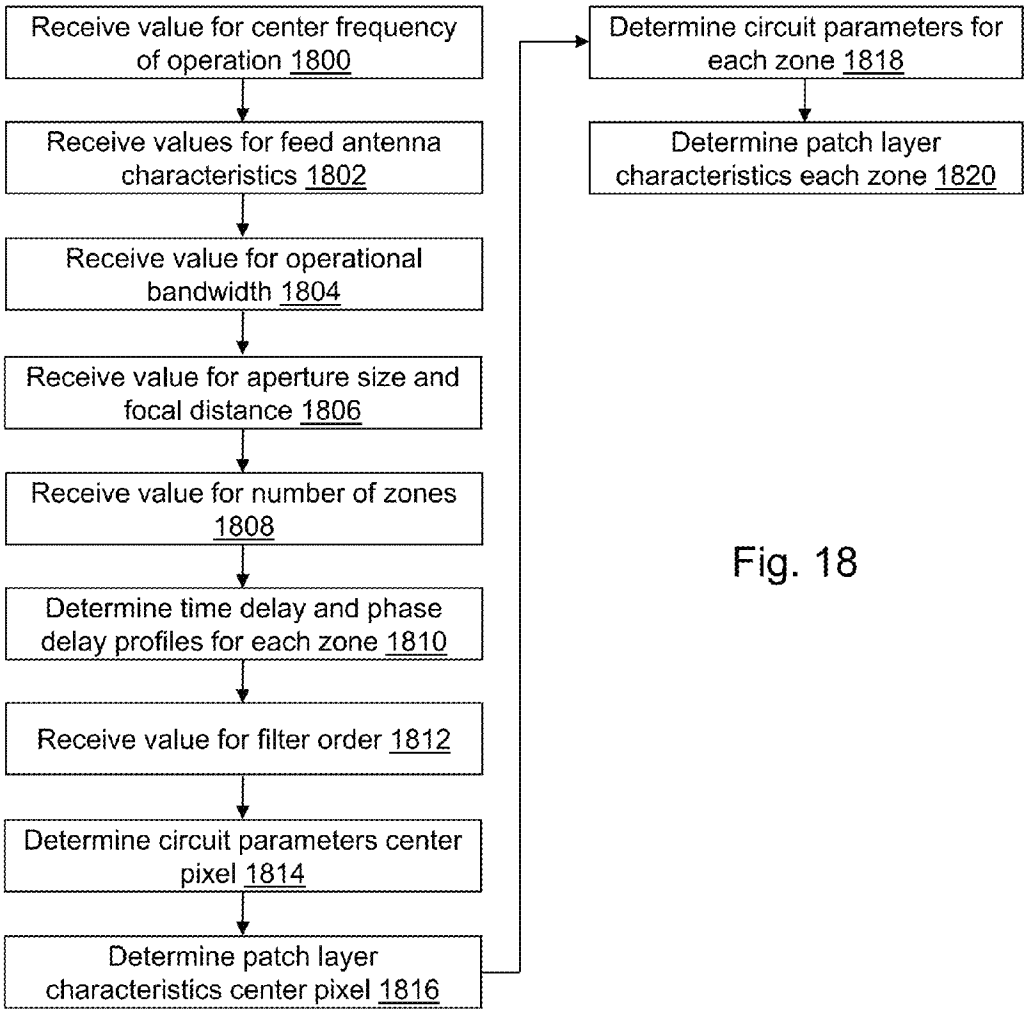
FIG. 18 depicts a flow diagram illustrating examples of operations associated with designing any of the plurality of tunable phase shifters in accordance with an illustrative embodiment.

With reference to FIG. 18, operations associated with designing any of the plurality of tunable phase shifters 604, 604*a*, 604*b*, 604*c*, 604*d*, 1600 are described in accordance with an illustrative embodiment. The operations may be performed by a transmitter design application 1918 shown with reference to FIG. 19. Additional, fewer, or different operations may be performed depending on the embodiment. The order of presentation of the operations of FIG. 18 is not intended to be limiting. Thus, although some of the operational flows are presented in sequence, the various operations may be performed in various repetitions, concurrently, and/or in other orders than those that are illustrated.

Figure 8:
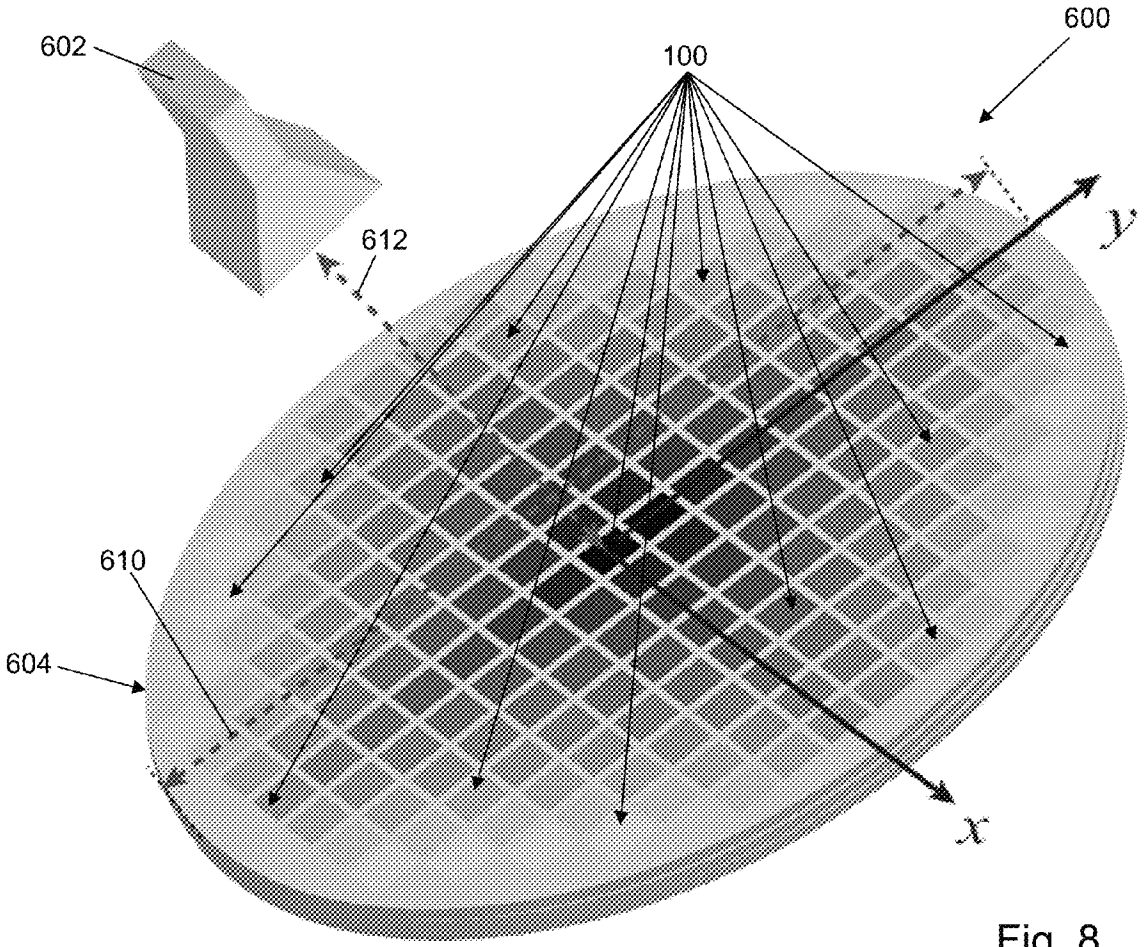
FIG. 8 depicts a perspective view of the transmitter of FIG. 6 in accordance with an illustrative embodiment.

For example, transmitter 600 shown with reference to FIG. 8 may be designed. The plurality of tunable phase shifters 604 is assumed to be located in an x-y plane. For illustration, the plurality of tunable phase shifters may be further assumed to have a circular aperture with a diameter of D equal to aperture length 610. The travel time it takes for the wave originated at feed antenna 602 to arrive at an arbitrary point on front face 605 of the plurality of tunable phase shifters with coordinates (x, y, z=0) is calculated as:

$$T(x,y,z=0)=\sqrt{x^2+y^2+f_d^2}/c$$

where $0<\sqrt{x^2+y^2}<D/2$ and $f_d$ is focal distance 612 between feed antenna 102 and the plurality of tunable phase shifters 604. The time delay profile that needs to be provided by the plurality of tunable phase shifters 604 can be calculated as:

$$TD(x,y,z=h)=(\sqrt{(D/2)^2+f_d^2}-r)/c+t_0 \quad (1)$$

where $r=\sqrt{x^2+y^2+f_d^2}$ and $t_0\geq 0$ is an arbitrary constant, which represents a constant time delay added to the response of each tunable phase shifter of the plurality of tunable phase shifters 604. The phase profile at the operating frequency can be calculated from:

$$\Phi(x,y)=k(\sqrt{(D/2)^2+f_d^2}-r)+\Phi_0 \quad (2)$$

where $\Phi_0$ is a positive constant that represents a constant phase delay added to the response of each tunable phase shifter of the plurality of tunable phase shifters 604 and $r=\sqrt{x^2+y^2+f_d^2}$ is the distance between an arbitrary tunable phase shifter specified by its coordinates (x, y, z=0) and feed antenna 102 (x=0, y=0, $z=f_d$).

To ensure that front face 605 of the plurality of tunable phase shifters 604 represents an equal phase and an equal delay surface, two conditions are satisfied across the aperture. First, the time delay profile provided for each tunable phase shifter calculated from equation (1) is approximately the same over the desired band of operation. Second, the phase shift profile at the operating frequency is approximately equal to that calculated from equation (2). Satisfying these two conditions ensures that the signal carried by the incident wave is not distorted. Moreover, it ensures that planar wave 608 at the output of the plurality of tunable phase shifters 604 is spatially coherent over the desired frequency range. Equation (1) is essentially the negative derivative of equation (2) with respect to the frequency, which is expected since, by definition, the group delay is defined as the negative derivative of the phase with respect to the frequency. Therefore, satisfying the phase condition in equation (2) at each frequency point within the desired frequency range automatically leads to the satisfaction of equation (1).

With reference to FIG. 18, in an operation 1800, a desired center frequency of operation is received. For example, a user may execute transmitter design application 1918 which causes presentation of a first user interface window, which may include a plurality of menus and selectors such as drop down menus, buttons, text boxes, hyperlinks, additional windows, etc. associated with transmitter design application 1918. The user, for example, may enter the frequency into a text box or select the frequency from a drop down menu. As understood by a person of skill in the art, the first user interface window is presented on a display 1914 (shown with reference to FIG. 19) under control of the computer-readable and/or computer-executable instructions of transmitter design application 1918 executed by a processor 1908 (shown with reference to FIG. 19) of a transmitter design system 1900 (shown with reference to FIG. 19). As the user interacts with the first user interface presented by transmitter design application 1918, different user interface windows may be presented to provide the user with more or less detailed information related to designing transmitter 600. Thus, as known to a person of skill in the art, transmitter design application 1918 receives an indicator associated with an interaction by the user with a user interface window presented under control of transmitter design application 1918. Based on the received indicator, transmitter design application 1918 performs one or more operations.

In an operation 1802, values for the characteristics of feed antenna 602 are received. For example, a type of feed element, a directivity, a half power beam width, a tapering, etc. may be selected or entered by a user.

In an operation 1804, an operational bandwidth for transmitter 600 is received. For example, the user may enter the bandwidth into a text box or select the bandwidth from a drop down menu. In an operation 1806, a desired size of the aperture of the plurality of tunable phase shifters 604 and a desired focal distance $f_d$ are received. For example, when the plurality of tunable phase shifters 604 are arranged in a circular shape, the user may enter the diameter D into a text box or select the diameter D from a drop down menu. The user also may enter the focal distance $f_d$ into a text box or select the focal distance $f_d$ from a drop down menu.

These parameters may be determined from practical design consideration such as a 3 dB beamwidth, an available volume for transmitter 600, and a maximum tolerable thickness depth of the plurality of tunable phase shifters 604. Another factor in choosing these parameters is a trade-off between a spillover loss and an aperture efficiency. To increase the efficiency of transmitter 600, spillover loss should be minimized. Spillover loss, however, is a function of a radiation pattern of feed antenna 602 and the $f_d/D$ ratio. For a given feed antenna 602, spillover loss can be reduced by reducing the $f_d/D$ ratio while ensuring the tapering over the aperture caused by this does not significantly decrease the aperture efficiency. A maximum bandwidth of transmitter 600 may be primarily limited by the bandwidth of feed antenna 602.

To define the time delay for each tunable phase shifter 100 of the plurality of tunable phase shifters 604, the aperture may be divided into M concentric zones with identical tunable phase shifters 100 populated within each zone. In an operation 1808, a number of discrete regions or zones into which to divide the aperture of the plurality of tunable phase shifters 604 is received. For example, the user may enter the number of zones into a text box or select the number of zones from a drop down menu. In general, the number of zones may be selected to provide a phase shift profile with as much continuity as possible, which in turn results in phase shift elements that are as small as possible compared to the wavelength band of interest.

In an operation 1810, a time delay and phase delay profile is determined for each zone using equations (3) and (4), respectively, below:

$$TD(x_m,y_m)=(\sqrt{(D/2)^2+f_d^2}-r_m)/c+t_0 \quad (3)$$

$$\Phi(x_m,y_m)=k_0(\sqrt{(D/2)^2+f_d^2}-r_m)+\Phi_0 \quad (4)$$

where $r_m=\sqrt{x_m^2+y_m^2+f_d^2}$, and where $x_m$, $y_m$ are the distances to the center of each zone and where m=0, 1, . . . , M−1.

The number of capacitive patch layers and dielectric sheet layers that form each tunable phase shifter 100 may be selected based on a filter order selected to achieve the maximum phase shift. In an operation 1812, a desired filter order for each tunable phase shifter 100 is received. For example, the user may enter the filter order into a text box or select the filter order from a drop down menu. Alternatively, transmitter design application 1918 may automatically calculate the filter order of each tunable phase shifter 100 based on a maximum time delay and phase delay.

The phase shift provided by each tunable phase shifter 100 is a function of the order of the filter and its bandwidth. Decreasing the bandwidth of the filter or increasing the order of the filter increases the phase shift achievable from it. In this design application, the phase shift and the bandwidth are known. Microwave filter design handbooks typically have tables and figures that show group delay responses of standard low-pass filters with different response types and orders. Once the required phase shift from each tunable phase shifter 100 and the desired bandwidth are determined, the minimum order of the filter that provides the required maximum phase shift can be determined by checking these standard filter responses. Any order higher than this minimum order also satisfies the response for the transmitter design. Alternatively, the filter order can be determined using computer simulations of simplified equivalent circuit model 500. The order of the filter can initially be estimated and the response of the simplified equivalent circuit model 500 simulated based on the estimate. Based on the simulated response, the order of the filter can be increased or decreased as necessary and the simulation process repeated to obtain the exact minimum order of the filter that provides a desired group delay. The number of dielectric sheet layers used to form each tunable phase shifter 100 of the plurality of tunable phase shifters 604 is defined as the desired filter order minus one and divided by two.

In an operation 1814, the equivalent circuit capacitance and transmission line and length values are defined to achieve the maximum phase shift profile defined for the associated tunable phase shifter 100 of the plurality of tunable phase shifters 604 given the desired filter order. In an operation 1816, the characteristics of dielectric substrate 104, spacer 106, conductive antenna element 102, and distance 112 of a tunable phase shifter 100 of the center pixel is calculated to provide a linear transmission phase with the steepest slope (or largest time delay) over the selected operational bandwidth. In an operation 1818, the equivalent circuit capacitance and transmission line impedance, and length values are defined to achieve the time delay and phase delay profile defined for each zone in equations (3) and (4), respectively, given the desired filter order.

In an operation 1820, the characteristics of dielectric substrate 104, spacer 106, conductive antenna element 102, and distance 112 of a tunable phase shifter 100 in each zone are calculated to provide the time delay and phase delay profile defined for each zone in equations (3) and (4), respectively. For example, this design process can be accomplished following well-known microwave filter design techniques and with the aid of computer aided design (CAD) tools to simulate the response of the equivalent circuit model 500 to ensure that the desired phase response is achieved. The dimensions of each tunable phase shifter 100 may be optimized using a full-wave EM simulation.

Figure 19:
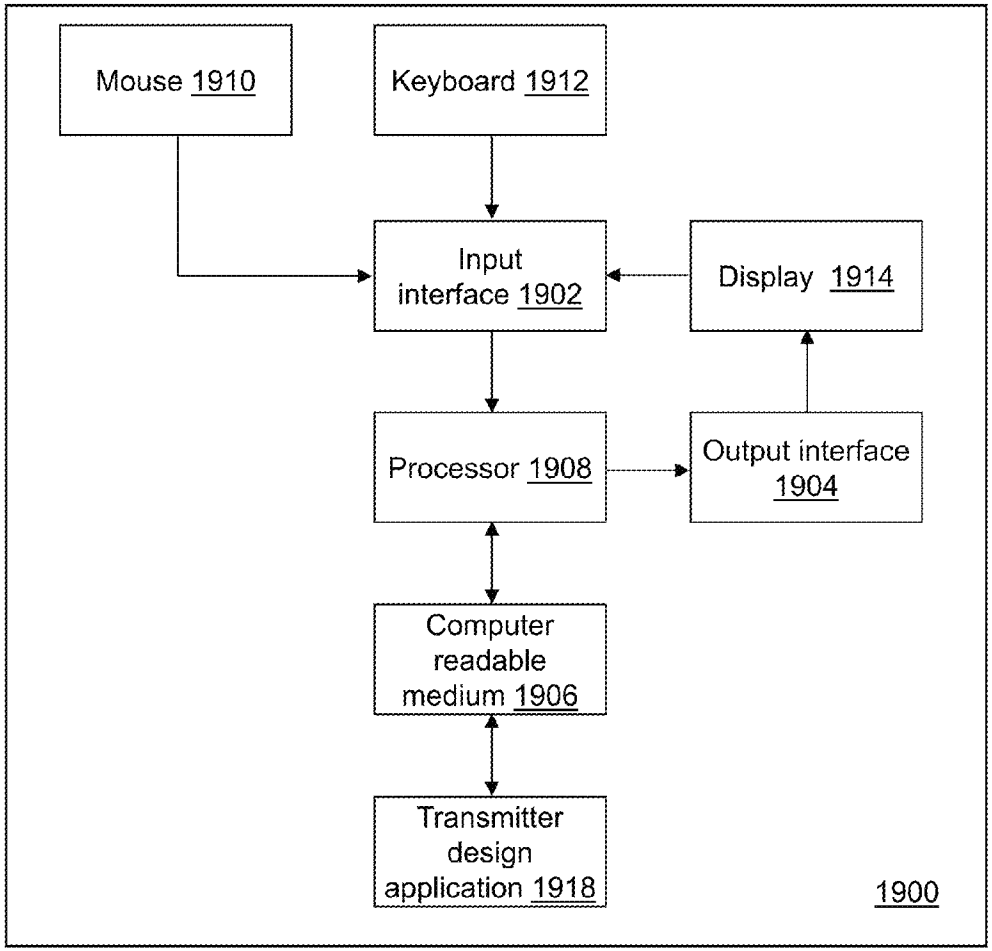
FIG. 19 depicts a block diagram of a transmitter design system in accordance with an illustrative embodiment.

With reference to FIG. 19, a block diagram of transmitter design system 1900 is shown in accordance with an illustrative embodiment. Transmitter design system 1900 may be a computing device of any form factor such as a personal digital assistant, a desktop, a laptop, an integrated messaging device, a smart phone, a tablet computer, etc. In an illustrative embodiment, transmitter design system 1900 may include an input interface 1902, an output interface 1904, a computer-readable medium 1906, and a processor 1908. Fewer, different, and additional components may be incorporated into transmitter design system 1900.

Input interface 1902 provides an interface for receiving information from the user for entry into transmitter design system 1900 as known to those skilled in the art. Input interface 1902 may interface with various input technologies including, but not limited to, a mouse 1910, a keyboard 1912, display 1914, a track ball, a keypad, one or more buttons, etc. to allow the user to enter information into transmitter design system 1900 or to make selections presented in a user interface displayed on display 1914. The same interface may support both input interface 1902 and output interface 1904. For example, display 1914 comprising a touch screen both allows user input and presents output to the user. Transmitter design system 1900 may have one or more input interfaces that use the same or a different input interface technology. The input devices further may be accessible by transmitter design system 1900 through a communication interface (not shown).

Output interface 1904 provides an interface for outputting information for review by a user of transmitter design system 1900. For example, output interface 1904 may interface with various output technologies including, but not limited to, display 1914, a printer, etc. Transmitter design system 1900 may have one or more output interfaces that use the same or a different interface technology. The output devices further may be accessible by transmitter design system 1900 through the communication interface.

Computer-readable medium 1906 is an electronic holding place or storage for information so that the information can be accessed by processor 1908 as known to those skilled in the art. Computer-readable medium 1906 can include, but is not limited to, any type of random access memory (RAM), any type of read only memory (ROM), any type of flash memory, etc. such as magnetic storage devices (e.g., hard disk, floppy disk, magnetic strips, . . . ), optical disks (e.g., CD, DVD, . . . ), smart cards, flash memory devices, etc. Transmitter design system 1900 may have one or more computer-readable media that use the same or a different memory media technology. Transmitter design system 1900 also may have one or more drives that support the loading of a memory media such as a CD or DVD, an external hard drive, etc.

Processor 1908 executes instructions as understood by those skilled in the art. The instructions may be carried out by a special purpose computer, logic circuits, or hardware circuits. Processor 1908 may be implemented in hardware and/or firmware. Processor 1908 executes an instruction, meaning it performs/controls the operations called for by that instruction. The term "execution" is the process of running an application or the carrying out of the operation called for by an instruction. The instructions may be written using one or more programming language, scripting language, assembly language, etc. Processor 1908 operably couples with input interface 1902, with output interface 1904, and with computer-readable medium 1906 to receive, to send, and to process information. Processor 1908 may retrieve a set of instructions from a permanent memory device and copy the instructions in an executable form to a temporary memory device that is generally some form of RAM.

Transmitter design application 1918 performs operations associated with designing transmitter 600. For example, transmitter design application 1918 is configured to perform one or more of the operations described with reference to FIG. 18. The operations may be implemented using hardware, firmware, software, or any combination of these methods. With reference to the example embodiment of FIG. 19, transmitter design application 1918 is implemented in software (comprised of computer-readable and/or computer-executable instructions) stored in computer-readable medium 1906 and accessible by processor 1908 for execution of the instructions that embody the operations of transmitter design application 1918. Transmitter design application 1918 may be written using one or more programming languages, assembly languages, scripting languages, etc. Transmitter design application 1918 may be implemented as a Web application.

Figure 20:
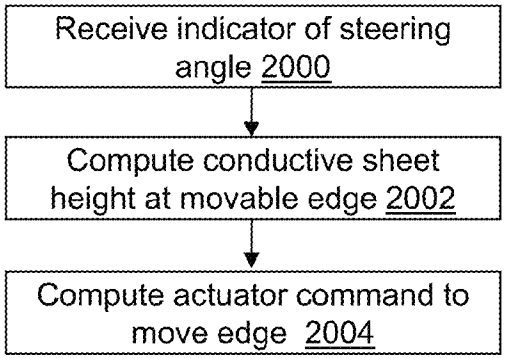
FIG. 20 depicts a flow diagram illustrating examples of operations associated with determining a movement to steer a beam in accordance with an illustrative embodiment.

With reference to FIG. 20, operations associated with determining a movement by one or more actuators 2112 (shown with reference to FIG. 21) to steer a beam radiated by transmitter 600 to a specific angle are described in accordance with an illustrative embodiment. For example, the one or more actuators 2112 are mounted to move conducting sheet 108 (or its sections) relative to spatial phase shift elements 101 to adjust a phase shift gradient. The operations may be performed by a beam steering control application 2110 shown with reference to FIG. 21. Additional, fewer, or different operations may be performed depending on the embodiment. The order of presentation of the operations of FIG. 20 is not intended to be limiting. Thus, although some of the operational flows are presented in sequence, the various operations may be performed in various repetitions, concurrently, and/or in other orders than those that are illustrated.

In an operation 2000, an indicator of a steering angle is received. For example, a receiver or target is located at a known steering angle relative to normal vector 1106.

In an operation 2002, a height of conductive sheet 108 is computed for one or more edges of conductive sheet 108 based on the phase shift gradient needed to steer the beam to the received steering angle.

In an operation 2004, an actuator command is computed to move the one or more edges of conductive sheet 108 to the computed height.

Figure 21:
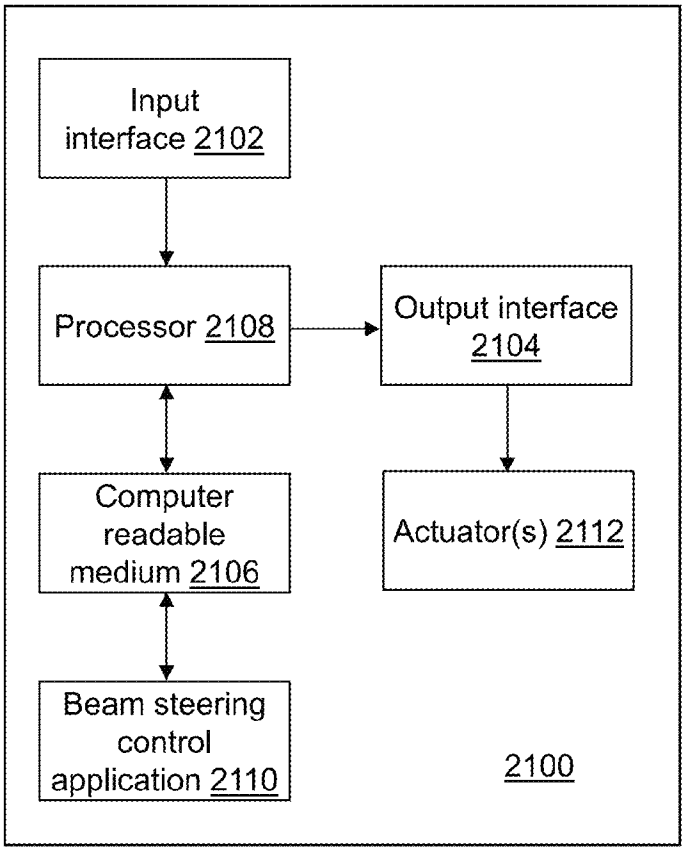
FIG. 21 depicts a block diagram of a beam steering control device in accordance with an illustrative embodiment.

With reference to FIG. 21, a block diagram of beam steering control device 2100 is shown in accordance with an illustrative embodiment. Beam steering control device 2100 may be a computing device of any form factor. In an illustrative embodiment, beam steering control system 2100 may include a second input interface 2102, a second output interface 2104, a second computer-readable medium 2106, a second processor 2108, beam steering control application 2110, and the one or more actuators 2112. Fewer, different, and additional components may be incorporated into beam steering control device 2100.

Second input interface 2102 provides the same or similar functionality as that described with reference to input interface 1902 though referring to beam steering control device 2100. Second output interface 2104 provides the same or similar functionality as that described with reference to output interface 1904 though referring to beam steering control device 2100. Second output interface 2104 also interfaces with the one or more actuators 2112 to provide the actuator command to each of the one or more actuators 2112. Second computer-readable medium 2106 provides the same or similar functionality as that described with reference to computer-readable medium 1906 though referring to beam steering control device 2100. Second processor 2108 provides the same or similar functionality as that described with reference to processor 1908 though referring to beam steering control device 2100.

Beam steering control application 2110 performs operations associated with determining a movement by the one or more actuators 2112 to steer a beam radiated by transmitter 600 to a specific angle. For example, beam steering control application 2110 is configured to perform one or more of the operations described with reference to FIG. 20. The operations may be implemented using hardware, firmware, software, or any combination of these methods. With reference to the example embodiment of FIG. 21, beam steering control application 2110 is implemented in software (comprised of computer-readable and/or computer-executable instructions) stored in second computer-readable medium 2106 and accessible by second processor 2108 for execution of the instructions that embody the operations of beam steering control application 2110. Beam steering control application 2110 may be written using one or more programming languages, assembly languages, scripting languages, etc.

Figure 23:
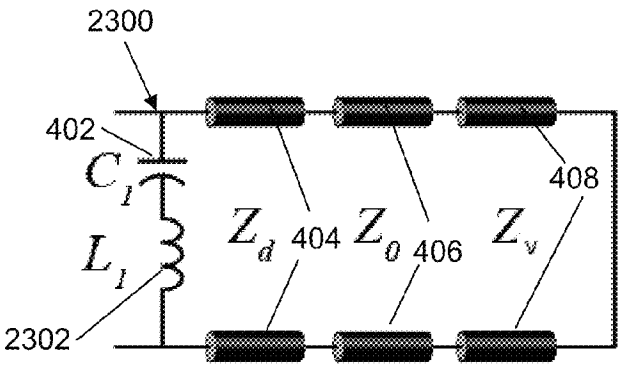
FIG. 23 depicts an equivalent circuit model of a tunable phase shifter formed using the conductive antenna element of FIG. 22 in accordance with an illustrative embodiment.
Figure 22:
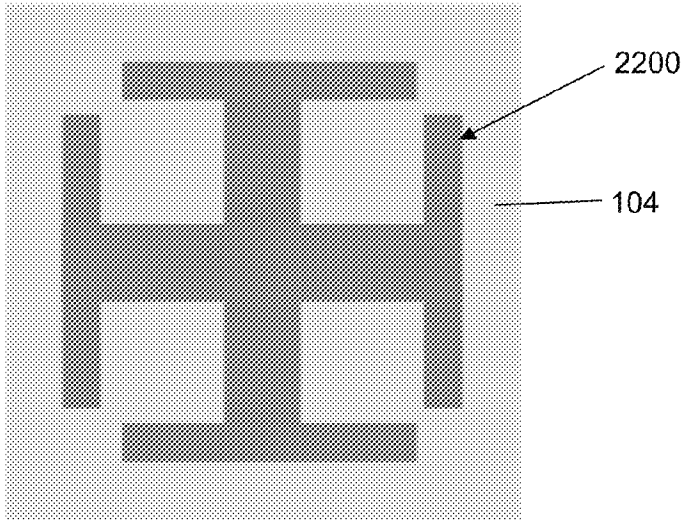
FIG. 22 depicts a conductive antenna element as a dipole-type Jerusalem cross resonator in accordance with an illustrative embodiment.

Conductive antenna element 102 can assume other shapes and architectures. For example, instead of non-resonant rectangular patches, resonant dipole antennas, tri-poles, Jerusalem crosses, or split ring resonators may be used. For example, referring to FIG. 22, conductive antenna element 102 is illustrated as a dipole-type Jerusalem cross resonator 2200 placed on dielectric substrate 104. Referring to FIG. 23, an equivalent circuit model 2300 of tunable phase shifter 100 with conductive antenna element 102 implemented as dipole-type Jerusalem cross resonator 2200 is shown in accordance with an illustrative embodiment. Equivalent circuit model 2300 may include capacitive element 402, an inductive element 2302, first transmission line element 404, second transmission line element 406, and third transmission line element 408. At its first resonance, dipole-type Jerusalem cross resonator 2200 (or any dipole resonator type) has an equivalent circuit model of a series LC. As a result, inductive element 2302 is in series with capacitive element 402 to represent the electrical effect of conductive antenna element 102 implemented as dipole-type Jerusalem cross resonator 2200. Capacitive element 402 may be tunable as well.

Figure 24:
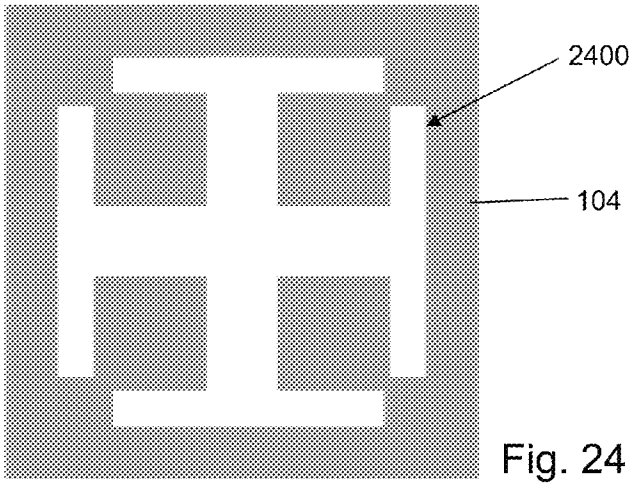
FIG. 24 depicts a conductive antenna element as a slot-type Jerusalem cross resonator in accordance with an illustrative embodiment.
Figure 25:
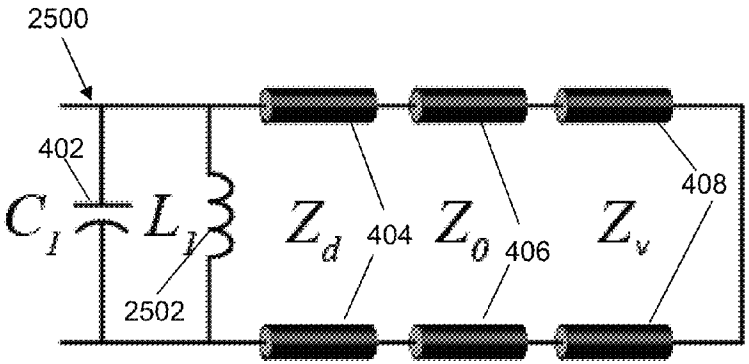
FIG. 25 depicts an equivalent circuit model of a tunable phase shifter formed using the conductive antenna element of FIG. 24 in accordance with an illustrative embodiment.

As another example, referring to FIG. 24, conductive antenna element 102 is illustrated as a slot-type Jerusalem cross resonator 2400 placed on dielectric substrate 104. Referring to FIG. 25, an equivalent circuit model 2500 of tunable phase shifter 100 with conductive antenna element 102 implemented as slot-type Jerusalem cross resonator 2400 is shown in accordance with an illustrative embodiment. Equivalent circuit model 2500 may include capacitive element 402, a second inductive element 2502, first transmission line element 404, second transmission line element 406, and third transmission line element 408. At its first resonance, slot-type Jerusalem cross resonator 2400 has an equivalent circuit model of a parallel LC. As a result, second inductive element 2502 is in parallel with capacitive element 402 to represent the electrical effect of conductive antenna element 102 implemented as slot-type Jerusalem cross resonator 2400. Capacitive element 402 may be tunable as well.

Figure 26:
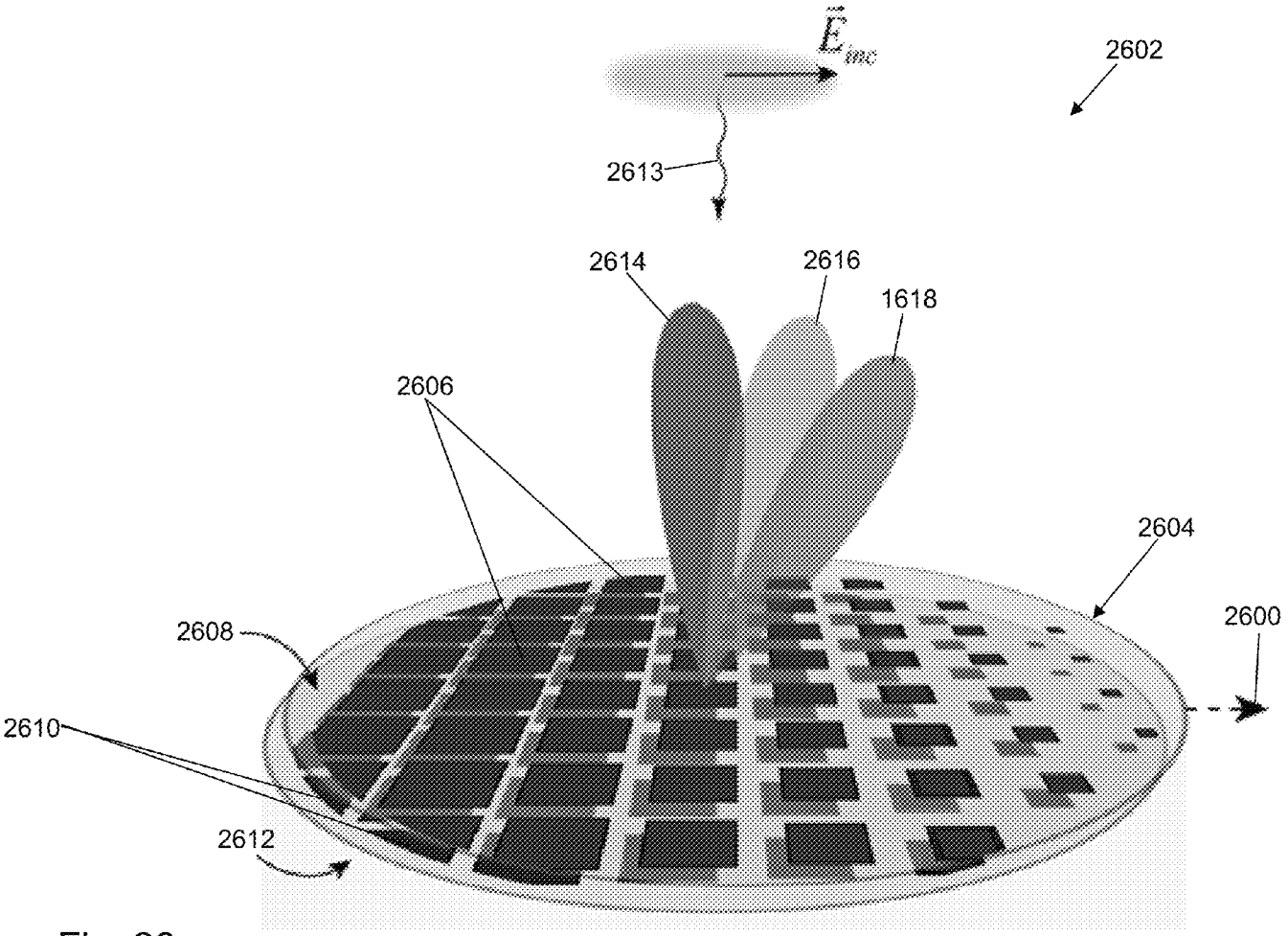
FIG. 26 depicts a perspective view of a second transmitter in accordance with an illustrative embodiment with laterally moving layers.

In addition to the architectures presented previously, other types of mechanical movements can also be used to perform beam steering. For example, referring to FIG. 26, a lateral movement is shown between layers of a multi-layer periodic structure. In alternative embodiments, a greater number of layers may be used. Referring to FIG. 26, a perspective view of a transmitter 2602 is shown. Transmitter 2602 may include feed antenna 602 (not shown) and an aperture 2604. Aperture 2604 may be formed of a bottom metal layer (not shown), a top metal layer 2606, a top dielectric layer 2608, a middle metal layer 2610, and a bottom dielectric layer 2612. Top metal layer 2606 is formed on top dielectric layer 2608 to form a first periodic arrangement of sub-wavelength capacitive patches. Middle metal layer 2610 is formed on bottom dielectric layer 2612 to form a second periodic arrangement of sub-wavelength capacitive patches. The bottom metal layer may be a continuous ground plane positioned on a side of bottom dielectric layer 2612 opposite middle metal layer 2610. In one direction, the first and second periodic arrangements of sub-wavelength capacitive patches are identical, and in the other direction, the dimensions of the patches change gradually as one moves away from one edge of aperture 2604 to an opposite edge. Aperture 2604 behaves as a reflect array antenna when illuminated with incident wave 2613 generated by and radiated from feed antenna 602. In the illustrative embodiment of FIG. 26, incident wave 2613 is shown to be incident from the direction normal to aperture 2604. A phase shift gradient provided by the distribution of the first and second periodic arrangements of sub-wavelength capacitive patches over aperture 2604 determines a direction of the radiated beam. As one of the layers of capacitive patches is moved with respect to the other, the phase shift gradient over aperture 2604 changes and the direction of the radiated beam in the far field also changes. For example, with the first and second periodic arrangements of sub-wavelength capacitive patches in a first position with respect to each other, a first radiated beam 2614 is generated by aperture 2604 by reflection in response to receipt of incident wave 2613. Moving top dielectric layer 2608 with the first periodic arrangement of sub-wavelength capacitive patches formed thereon in a first direction 2600 without moving bottom dielectric layer 2612 or the bottom metal layer, a second radiated beam 2616 is generated by aperture 2604 by reflection in response to receipt of incident wave 2613. Moving top dielectric layer 2608 with the first periodic arrangement of sub-wavelength capacitive patches formed thereon further in the first direction 2600 without moving bottom dielectric layer 2612 or the bottom metal layer, a third radiated beam 2618 is generated by aperture 2604 by reflection in response to receipt of incident wave 2613. As a result, relative lateral movement between top dielectric layer 2608 with the first periodic arrangement of sub-wavelength capacitive patches and bottom dielectric layer 2612 with the second periodic arrangement of sub-wavelength capacitive patches steers a radiated beam.

Figures 27A, 27B:
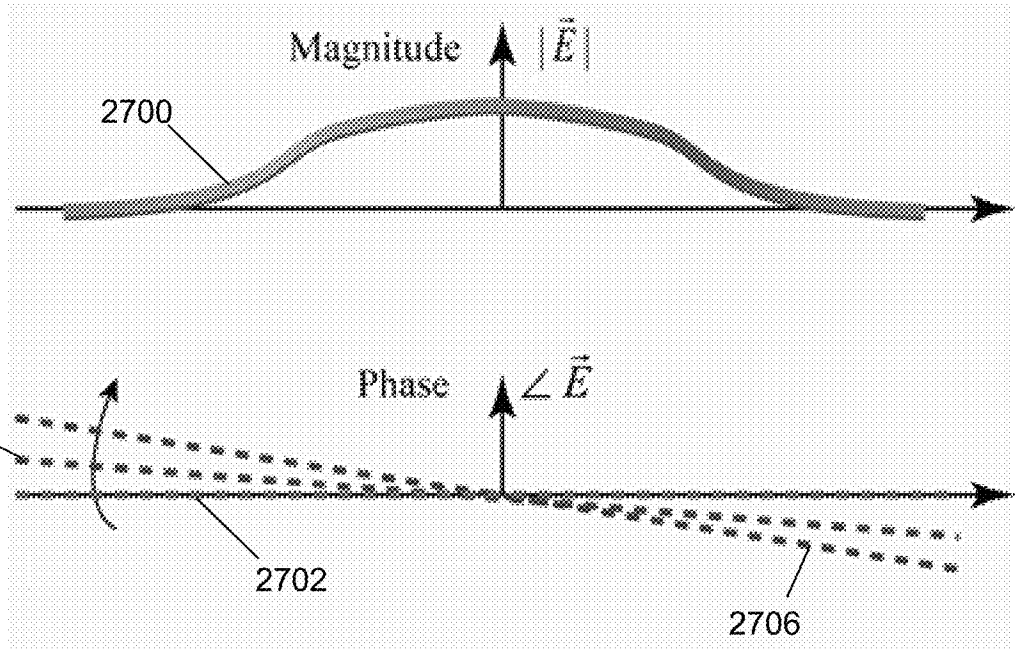
FIG. 27*a* depicts a magnitude of an electrical field distribution of the second transmitter of FIG. 26 in accordance with an illustrative embodiment.
FIG. 27*b* depicts a phase of the electrical field distribution of the second transmitter of FIG. 26 for three different lateral positions in accordance with an illustrative embodiment.

Illumination of aperture 2604 by incident wave 2613 creates an electric field distribution over aperture 2604. Referring to FIG. 27*a*, a magnitude 2700 of the electric field distribution over aperture 2604 is shown. The phase of the electric field distribution over the antenna aperture determines its radiation properties in the far field. Referring to FIG. 27*b*, a first phase distribution 2702 of the electric field distribution over aperture 2604 is shown that results in radiation of first radiated beam 2614. A second phase distribution 2704 of the electric field distribution over aperture 2604 is shown that results in radiation of second radiated beam 2616. A third phase distribution 2706 of the electric field distribution over aperture 2604 is shown that results in radiation of third radiated beam 2618. In particular, the phase shift gradient of the E-field distribution over aperture 2604 determines the direction of the maximum radiation of transmitter 2602 in the far-field. Either or both periodic structure can be moved with respect to the other to achieve the beam steering.

Figure 28:
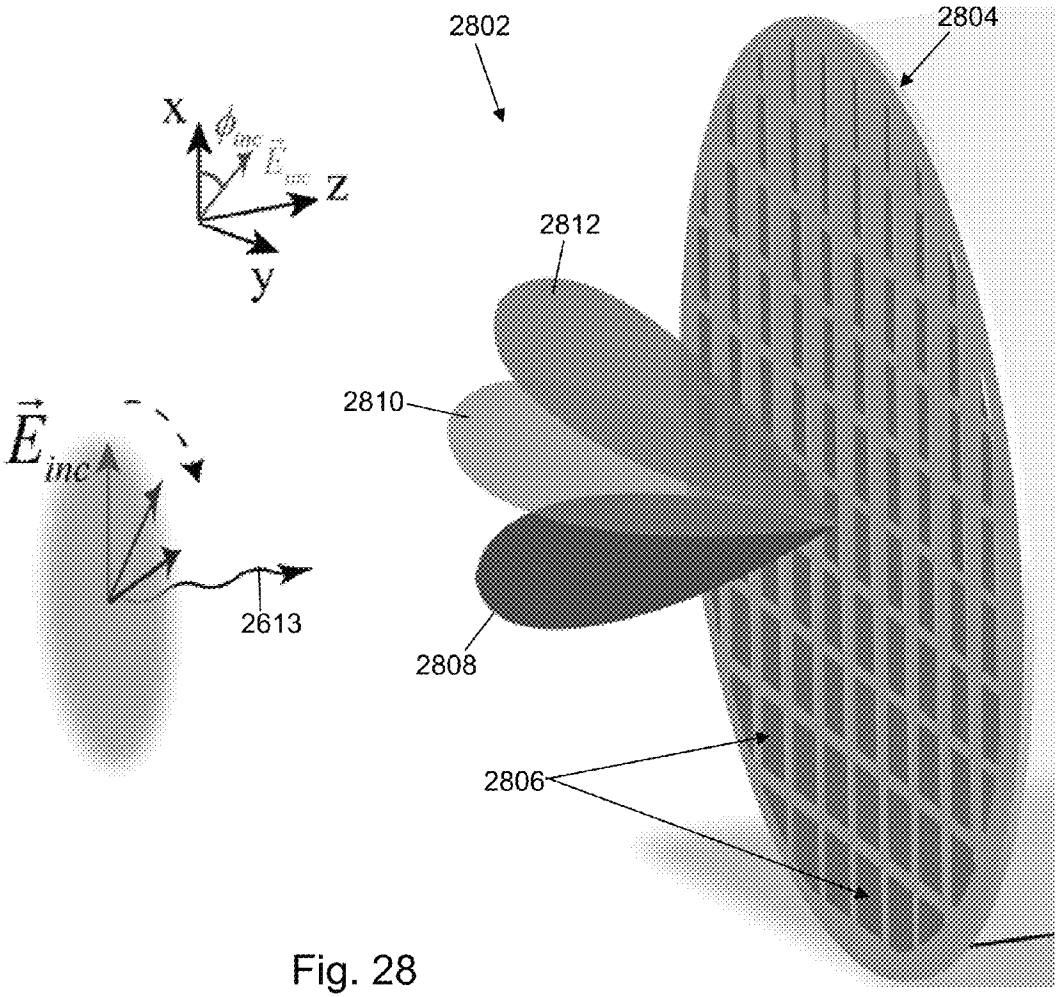
FIG. 28 depicts a perspective view of a third transmitter in accordance with an illustrative embodiment with rotating element.

As another example, referring to FIG. 28, a rotational movement is shown between layers of a multi-layer periodic structure. Referring to FIG. 28, a perspective view of a transmitter 2802 is shown. Transmitter 2802 may include feed antenna 602 (not shown) and an aperture 2804. Aperture 2804 is populated by pixels 2806 acting as spatial phase shifters. These phase shifters are the unit cells of an anisotropic impedance surface whose impedance is a function of the polarization of the incident wave. In such a structure, if the polarization of the incident wave is rotated, the phase shift gradient provided over aperture 2804 of transmitter 2802 can be changed dynamically. Thus, the direction of the radiated field in the far field can be changed as well. There is no need to physically rotate aperture 2804. Feed antenna 602 can be rotated or the direction of polarization of feed antenna 602 can be electronically tuned. However, this will change the polarization of the radiated field as well, which may not be desirable in certain applications.

Equivalently the polarization of incident wave 606 can be set and aperture 2804 rotated in its plane to change the direction of the radiated field in the far field and accomplish beam steering. The polarization of the radiated wave is maintained, but the direction of maximum radiation can still change.

A first relative rotation may generate a first radiated beam 2808 from aperture 2804 by reflection in response to receipt of incident wave 2613. A second relative rotation may generate a second radiated beam 2810 from aperture 2804 by reflection in response to receipt of incident wave 2613. A third relative rotation may generate a third radiated beam 2812 from aperture 2804 by reflection in response to receipt of incident wave 2613.

Figures 29A, 29B:
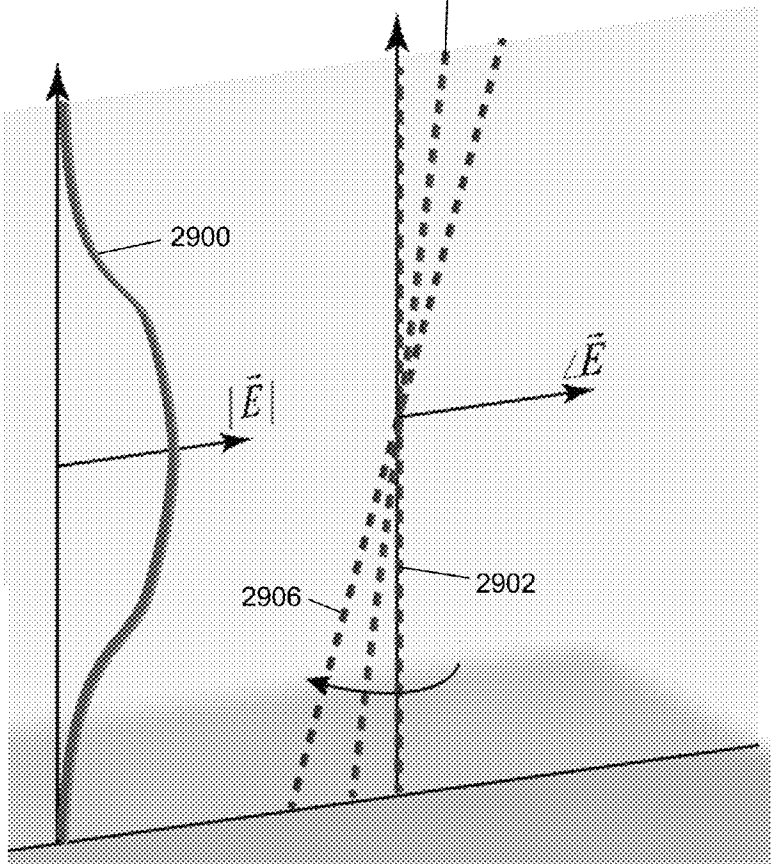
FIG. 29*a* depicts a magnitude of an electrical field distribution of the third transmitter of FIG. 28 in accordance with an illustrative embodiment.
FIG. 29*b* depicts a phase of the electrical field distribution of the third transmitter of FIG. 28 for three different rotational positions in accordance with an illustrative embodiment.

Referring to FIG. 29*a*, a magnitude 2900 of the electric field distribution over aperture 2804 is shown. Referring to FIG. 29*b*, a first phase distribution 2902 of the electric field distribution over aperture 2804 is shown that results in radiation of first radiated beam 2808. A second phase distribution 2904 of the electric field distribution over aperture 2804 is shown that results in radiation of second radiated beam 2810. A third phase distribution 2906 of the electric field distribution over aperture 2804 is shown that results in radiation of third radiated beam 2812.

The word "illustrative" is used herein to mean serving as an example, instance, or illustration. Any aspect or design described herein as "illustrative" is not necessarily to be construed as preferred or advantageous over other aspects or designs. Further, for the purposes of this disclosure and unless otherwise specified, "a" or "an" means "one or more". Still further, using "and" or "or" in the detailed description is intended to include "and/or" unless specifically indicated otherwise. The illustrative embodiments may be implemented as a method, apparatus, or article of manufacture using standard programming and/or engineering techniques to produce software, firmware, hardware, or any combination thereof to control a computer to implement the disclosed embodiments.

Any directional references used herein, such as left side, right side, top, bottom, back, front, up, down, above, below, etc., are for illustration only based on the orientation in the drawings selected to describe the illustrative embodiments.

The foregoing description of illustrative embodiments of the disclosed subject matter has been presented for purposes of illustration and of description. It is not intended to be exhaustive or to limit the disclosed subject matter to the precise form disclosed, and modifications and variations are possible in light of the above teachings or may be acquired from practice of the disclosed subject matter. The embodiments were chosen and described in order to explain the principles of the disclosed subject matter and as practical applications of the disclosed subject matter to enable one skilled in the art to utilize the disclosed subject matter in various embodiments and with various modifications as suited to the particular use contemplated.

What is claimed is:

1. A tunable phase shifter comprising:

a spatial phase shift element comprising a dielectric substrate; and a conductive antenna element mounted on the dielectric substrate;

a conducting sheet mounted a distance from the spatial phase shift element and configured to reflect an electromagnetic wave through the spatial phase shift element; and an actuator mounted to the conducting sheet and configured to move the conducting sheet relative to the spatial phase shift element to change the distance between the conducting sheet and the spatial phase shift element, wherein the conductive antenna element is configured to radiate a second electromagnetic wave in response to receipt of the reflected electromagnetic wave, wherein the distance between the conducting sheet and the spatial phase shift element can be changed to adjust a phase shift of the reflected electromagnetic wave.

2. The tunable phase shifter of claim 1, wherein the conductive antenna element is selected from the group consisting of a patch antenna element, a resonant dipole antenna element, a tri-pole antenna element, a Jerusalem cross antenna element, a split ring resonator antenna element, a multi-element dipole antenna element, and a leaky wave antenna element.

3. The tunable phase shifter of claim 1, wherein the conducting sheet is formed of a flexible membrane coated with a conductor.

4. The tunable phase shifter of claim 3, wherein the flexible membrane is moved relative to an anchor point of the flexible membrane to change the distance between the conducting sheet and the spatial phase shift element.

5. The tunable phase shifter of claim 4, wherein the flexible membrane is anchored at a plurality of points.

6. The tunable phase shifter of claim 1, wherein the conducting sheet is tilted relative to the spatial phase shift element to change the distance between the conducting sheet and the spatial phase shift element.

7. The tunable phase shifter of claim 1, further comprising a spacer positioned between the conducting sheet and the spatial phase shift element, wherein the spacer is filled with a dielectric material.

8. The tunable phase shifter of claim 7, wherein the dielectric material is air.

9. A phased array antenna comprising:

a feed antenna configured to radiate an electromagnetic wave;

a plurality of spatial phase shift elements distributed linearly in a direction, wherein each spatial phase shift element of the plurality of spatial phase shift elements comprises a dielectric substrate; and a conductive antenna element mounted on the dielectric substrate; and a conducting sheet mounted a distance from the plurality of spatial phase shift elements and configured to reflect the radiated electromagnetic wave through the plurality of spatial phase shift elements;

wherein the conductive antenna element of each of the plurality of spatial phase shift elements is configured to radiate a second electromagnetic wave in response to receipt of the reflected electromagnetic wave, wherein the distance between the conducting sheet and the plurality of spatial phase shift elements can be changed to adjust a phase shift of the reflected electromagnetic wave.

10. The phased array antenna of claim 9, wherein the plurality of spatial phase shift elements are distributed linearly in two directions to form a two-dimensional array.

11. The phased array antenna of claim 9, further comprising an actuator mounted to the conducting sheet and configured to tilt the conducting sheet relative to the plurality of spatial phase shift elements to change the distance between the conducting sheet and the plurality of spatial phase shift elements.

12. The phased array antenna of claim 9, wherein the conducting sheet comprises a plurality of sections, wherein the plurality of sections are independently moveable.

13. The phased array antenna of claim 12, further comprising an actuator mounted to each of the plurality of sections, wherein the actuator is configured to move the section to which it is mounted to change the distance between the section and the plurality of spatial phase shift elements.

14. The phased array antenna of claim 12, wherein a number of the plurality of sections is equal to a number of the plurality of spatial phase shift elements.

15. The phased array antenna of claim 12, wherein a number of the plurality of sections is less than a number of the plurality of spatial phase shift elements.

16. The tunable phase shifter of claim 9, wherein the feed antenna is selected from the group consisting of a patch antenna, a dipole antenna, a monopole antenna, a helical antenna, a microstrip antenna, a fractal antenna, a feed horn, a slot antenna, an end fire antenna, and a parabolic antenna.

17. The phased array antenna of claim 9, wherein the feed antenna is mounted between the plurality of spatial phase shift elements and the conducting sheet.

18. The phased array antenna of claim 9, further comprising a spacer positioned between the conducting sheet and the plurality of spatial phase shift elements, wherein the spacer is filled with a dielectric material.

19. A phased array antenna system comprising:

a feed antenna configured to radiate an electromagnetic wave;

a radiating antenna comprising a plurality of spatial phase shift elements distributed linearly in a direction, wherein each spatial phase shift element of the plurality of spatial phase shift elements comprises a dielectric substrate; and a conductive antenna element mounted on the dielectric substrate; and a conducting sheet mounted a distance from the plurality of spatial phase shift elements and configured to reflect the radiated electromagnetic wave through the plurality of spatial phase shift elements, wherein the conductive antenna element of each of the plurality of spatial phase shift elements is configured to radiate a second electromagnetic wave in response to receipt of the reflected electromagnetic wave; and an actuator mounted to the radiating antenna and configured to change the distance between the conducting sheet and the plurality of spatial phase shift elements.

20. The phased array antenna system of claim 19, further comprising a spacer positioned between the conducting sheet and the plurality of spatial phase shift elements, wherein the spacer is filled with a dielectric material.

* * * * *